US009359157B2

(12) United States Patent
Niikura et al.

(10) Patent No.: US 9,359,157 B2
(45) Date of Patent: Jun. 7, 2016

(54) SHEET FEEDING DEVICE AND IMAGE FORMING APPARATUS

(71) Applicants: Yasuo Niikura, Kanagawa (JP); Hidetoshi Kojima, Kanagawa (JP); Yuuta Mori, Kanagwa (JP); Takashi Fukumoto, Kanagawa (JP); Kiyotake Nakamura, Kanagawa (JP); Munehisa Fuda, Kanagawa (JP); Hideaki Takahashi, Kanagawa (JP); Hisayoshi Sugawara, Kanagawa (JP); Kazunori Konno, Kanagawa (JP); Tatsuya Sugawara, Kanagawa (JP); Kohjiroh Haga, Kanagawa (JP); Toshihiro Okutsu, Kanagawa (JP)

(72) Inventors: Yasuo Niikura, Kanagawa (JP); Hidetoshi Kojima, Kanagawa (JP); Yuuta Mori, Kanagwa (JP); Takashi Fukumoto, Kanagawa (JP); Kiyotake Nakamura, Kanagawa (JP); Munehisa Fuda, Kanagawa (JP); Hideaki Takahashi, Kanagawa (JP); Hisayoshi Sugawara, Kanagawa (JP); Kazunori Konno, Kanagawa (JP); Tatsuya Sugawara, Kanagawa (JP); Kohjiroh Haga, Kanagawa (JP); Toshihiro Okutsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/715,738
(22) Filed: May 19, 2015

(65) Prior Publication Data

US 2016/0016740 A1 Jan. 21, 2016

(30) Foreign Application Priority Data

May 20, 2014 (JP) ..... 2014-104410
Nov. 4, 2014 (JP) ..... 2014-224014

(51) Int. Cl.
*B65H 1/00* (2006.01)
*B65H 1/26* (2006.01)

(Continued)

(52) U.S. Cl.
CPC ..... *B65H 1/266* (2013.01); *B65H 1/04* (2013.01); *B65H 1/18* (2013.01); *B65H 3/14* (2013.01); *B65H 2402/33* (2013.01); *B65H 2405/11161* (2013.01); *B65H 2511/11* (2013.01)

(58) Field of Classification Search
CPC ..... B65H 1/00; B65H 1/04; B65H 1/28; B65H 1/266; B65H 2402/30; B65H 2402/33; B65H 2045/10; B65H 2045/11; B65H 2045/1116; B65H 2045/11161; B65H 2045/11164; B65H 2045/111643; B65H 2045/111646; B65H 2045/1117; B65H 2045/11171; B65H 2045/11172; B65H 2045/115
See application file for complete search history.

(56) References Cited

U.S. PATENT DOCUMENTS 8,191,892 B2 6/2012 Fuda
8,727,342 B2 5/2014 Fukumoto et al.

(Continued)

FOREIGN PATENT DOCUMENTS

JP 2002-160850 6/2002
JP 2002-274661 9/2002

(Continued)

*Primary Examiner* — Prasad Gokhale
(74) *Attorney, Agent, or Firm* — Harness, Dickey & Pierce, P.L.C.

(57) ABSTRACT

A sheet feeding device includes: a sheet feeding tray attached to a casing in a manner slidable into and out from the casing and including a stacking plate on which sheets are stacked; a conveying unit configured to convey the sheets in a direction orthogonal to both a sliding direction of the sheet feeding tray and a stacking direction of the sheets; an optional extension unit configured to be removably attached to an upstream side of the stacking plate in a conveying direction, and including an extension plate configured to extend the stacking plate; and a first locking unit configured to be capable of being held in a first lock position where the sheet feeding tray cannot be slide when the optional extension unit is attached while, when the optional extension unit is removed, held in a first unlock position where the sheet feeding tray can be slid.

20 Claims, 24 Drawing Sheets

(51) Int. Cl.

| | |
|---|---|
| ***B65H 1/04*** | (2006.01) |
| ***B65H 3/14*** | (2006.01) |
| ***B65H 1/18*** | (2006.01) |

(56) References Cited

U.S. PATENT DOCUMENTS

| | | | | |
|---|---|---|---|---|
| 2004/0169327 | A1* | 9/2004 | Swayze | B41J 13/103 271/145 |
| 2013/0062827 | A1 | 3/2013 | Fuda | |
| 2013/0087967 | A1 | 4/2013 | Fuda et al. | |
| 2013/0106045 | A1 | 5/2013 | Okutsu et al. | |
| 2013/0334764 | A1 | 12/2013 | Fuda | |
| 2014/0008861 | A1* | 1/2014 | Kotaka | B65H 1/00 271/9.08 |
| 2014/0167348 | A1* | 6/2014 | Samoto | B65H 1/266 271/166 |
| 2014/0339759 | A1 | 11/2014 | Takahashi et al. | |
| 2014/0339761 | A1 | 11/2014 | Oikawa et al. | |
| 2014/0346728 | A1 | 11/2014 | Fuda et al. | |

FOREIGN PATENT DOCUMENTS

| | | |
|---|---|---|
| JP | 2006-232534 | 9/2006 |
| JP | 2012-158475 | 8/2012 |
| JP | 2012-254853 | 12/2012 |
| JP | 2013-056740 | 3/2013 |
| JP | 2014-001059 | 1/2014 |
| JP | 2014-114115 | 6/2014 |
| JP | 2014-148379 | 8/2014 |
| JP | 2014-152023 | 8/2014 |
| JP | 2014-169154 | 9/2014 |
| JP | 2014-169182 | 9/2014 |
| JP | 2014-172702 | 9/2014 |
| JP | 2014-172703 | 9/2014 |
| JP | 2015-009926 | 1/2015 |

* cited by examiner

SHEET FEEDING DEVICE AND IMAGE FORMING APPARATUS

CROSS-REFERENCE TO RELATED APPLICATIONS

The present application claims priority to and incorporates by reference the entire contents of Japanese Patent Application No. 2014-104410 filed in Japan on May 20, 2014 and Japanese Patent Application No. 2014-224014 filed in Japan on Nov. 4, 2014.

BACKGROUND OF THE INVENTION

1. Field of the Invention

The present invention relates to a sheet feeding device and an image forming apparatus.

2. Description of the Related Art

As the sheet feeding devices, large-capacity sheet feeding devices configured to hold a large amount of sheets of media and feed the sheets one at a time to an image forming apparatus are known. Demands for printing on long sheets (e.g., a banner page (cover page), a double-page spread in a brochure, and an advertising banner) longer than sheets of a standard size such as A4 or A3 size are growing in recent years in printing market.

Some known types of the large-capacity sheet feeding devices include a sheet feeding tray capable of holding a large amount of sheets. An example of such a large-capacity sheet feeding device is disclosed in Japanese Laid-open Patent Application No. 2006-232534. However, long sheets, which are sheets longer than standard-size sheets, cannot be stacked on a sheet feeding tray of a general large-capacity sheet feeding device. For this reason, stacking, feeding, and performing printing on long sheets have conventionally been performed by repeatedly stacking a small amount of the long sheets on a bypass tray.

To avoid the inconvenience described above, the applicant has conceived to extend a tray bottom plate of a sheet feeding tray of a large-capacity sheet feeding device by removably attaching an extension bottom plate to the tray bottom plate so that long sheets can be fed by utilizing the sheet feeding tray. The extension bottom plate is removably attached to the upstream side of the sheet feeding tray in a sheet feeding direction.

Accordingly, if a user should pull the sheet feeding tray to stack sheets or to fix paper jam, the extension bottom plate can be damaged by being caught by a casing. It is desired to solve this disadvantage.

Under the circumstances, there is a need for a sheet feeding device and an image forming apparatus capable of preventing the extension bottom plate from being damaged.

SUMMARY OF THE INVENTION

It is an object of the present invention to at least partially solve the problems in the conventional technology.

A sheet feeding device includes: a casing; a sheet feeding tray attached to the casing in a manner that the sheet feeding tray can be slid into and out from the casing and including a stacking plate on which sheets are to be stacked; a conveying unit configured to convey the sheets stacked on the stacking plate in a direction orthogonal to both a sliding direction of the sheet feeding tray and a stacking direction of the sheets; an optional extension unit configured to be removably attached to an upstream side of the stacking plate in a conveying direction, and including an extension plate configured to extend the stacking plate to allow a long sheet to be stacked; and a first locking unit configured to be capable of being held in a first lock position where the sheet feeding tray cannot be slide when the optional extension unit is attached while, when the optional extension unit is removed, held in a first unlock position where the sheet feeding tray can be slid.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

First Embodiment

A first embodiment of the present invention is described below with reference to FIGS. 1 to 14B. A large-capacity-sheet-feeding tray unit (LCT) 1, which is an example of sheet feeding device, illustrated in FIGS. 1 to 14B is a device that conveys sheets of media stacked on a sheet feeding tray 3 one at a time to an image forming unit. The image forming unit is a device that forms an image on the sheet conveyed from the LCT 1 and built in an image forming apparatus together with the LCT 1. The LCT 1 according to the first embodiment can hold only sheets of standard sizes such as A4 size in the sheet feeding tray 3 in the normal state. However, in a state where an optional extension unit 6, which will be described later, is attached to the sheet feeding tray 3, long sheets 7 which are longer than standard size sheets can be stacked on the sheet feeding tray 3.

Figure 1:
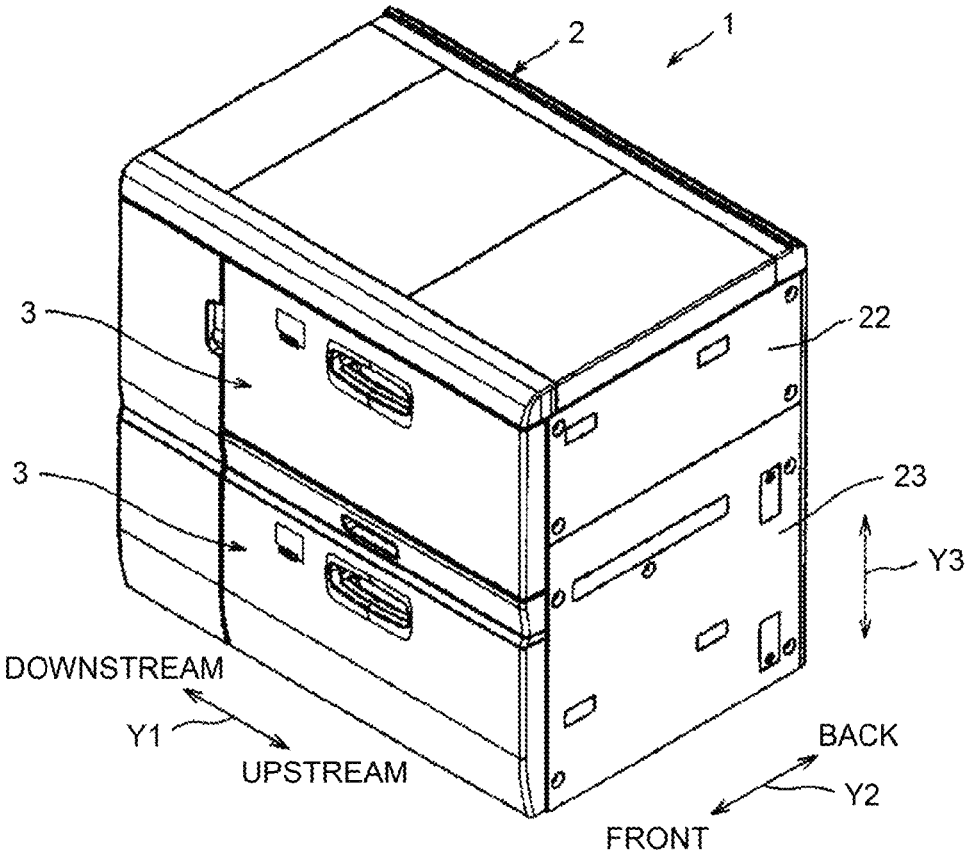
FIG. 1 is a perspective view illustrating a large-capacity-sheet-feeding tray unit (LCT) which is an example of sheet feeding device according to a first embodiment of the present invention.
Figure 2:
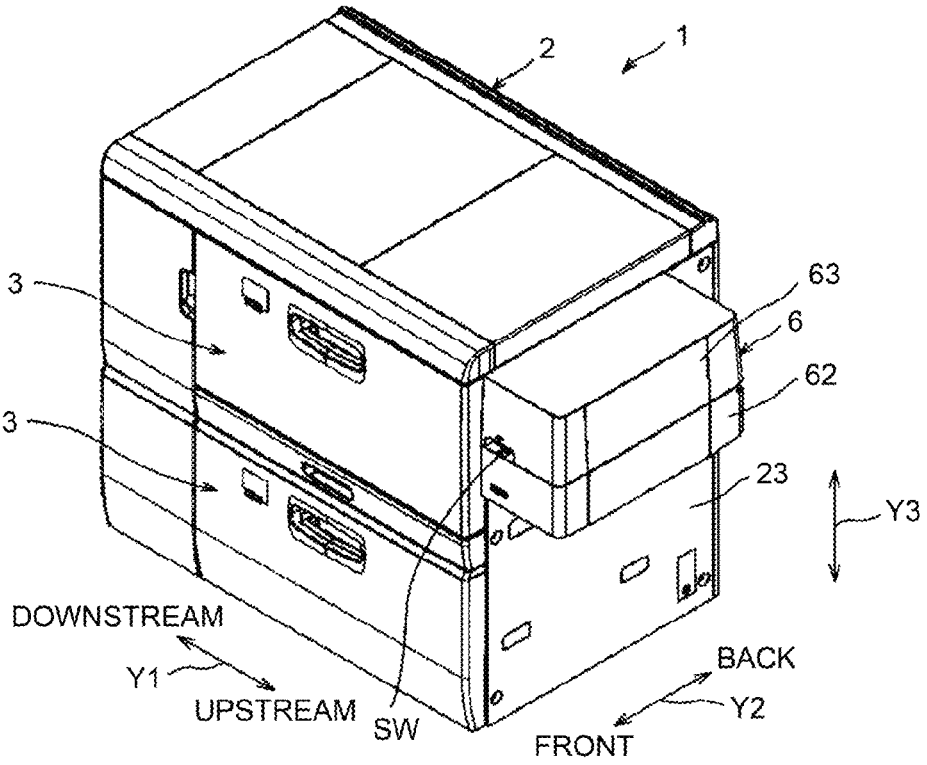
FIG. 2 is a perspective view illustrating the LCT illustrated in FIG. 1 with an optional extension unit attached thereto.

As illustrated in FIG. 1 and other drawings, the LCT 1 according to the first embodiment includes a casing 2 and the sheet feeding tray 3 including a tray bottom plate 31 (FIG. 6), which is an example of a stacking plate where sheets are to be stacked, and is attached to the casing 2 such that the sheet feeding tray 3 can slide into and out from the casing 2. As illustrated in FIGS. 5A to 6B, the LCT 1 includes a drive unit 4 that lifts up/down the tray bottom plate 31 and slide rails 51 and 52 for holding the sheet feeding tray 3 such that the sheet feeding tray 3 can slide into and out from the casing 2. The LCT 1 further includes a conveying unit (which includes a conveyance belt 12 to be described later) which is an example of a conveying means that conveys the sheets stacked on the tray bottom plate 31 one at a time to the image forming unit. As illustrated in FIGS. 2 to 4 and FIGS. 10A and 10B, the LCT 1 further includes the optional extension unit 6 including an extension bottom plate 61 which is an example of extension plate for extending the tray bottom plate 31 upstream with respect to a conveying direction Y1, thereby allowing the long sheets 7 to be stacked on the tray bottom plate 31.

As illustrated in FIG. 1 and other drawings, the casing 2 is made into a box shape from a frame, a plurality of panels 22 and 23 attached to the frame, and the like. The conveying unit is housed in the downstream portion of the casing 2 in the conveying direction Y1. The sheet feeding tray 3, which will be described later, is housed in the upstream portion of the casing 2 in the conveying direction Y1. The casing 2 houses two pieces of the sheet feeding tray 3, one in an upper section, the other in a lower section. An opening 21 (FIGS. 5A and 5B) is defined in the casing 2 on the front side with respect to a sliding direction Y2. By sliding the sheet feeding tray 3 toward the front, the sheet feeding tray 3 can be drawn out from the casing 2 through the opening 21.

Figure 3:
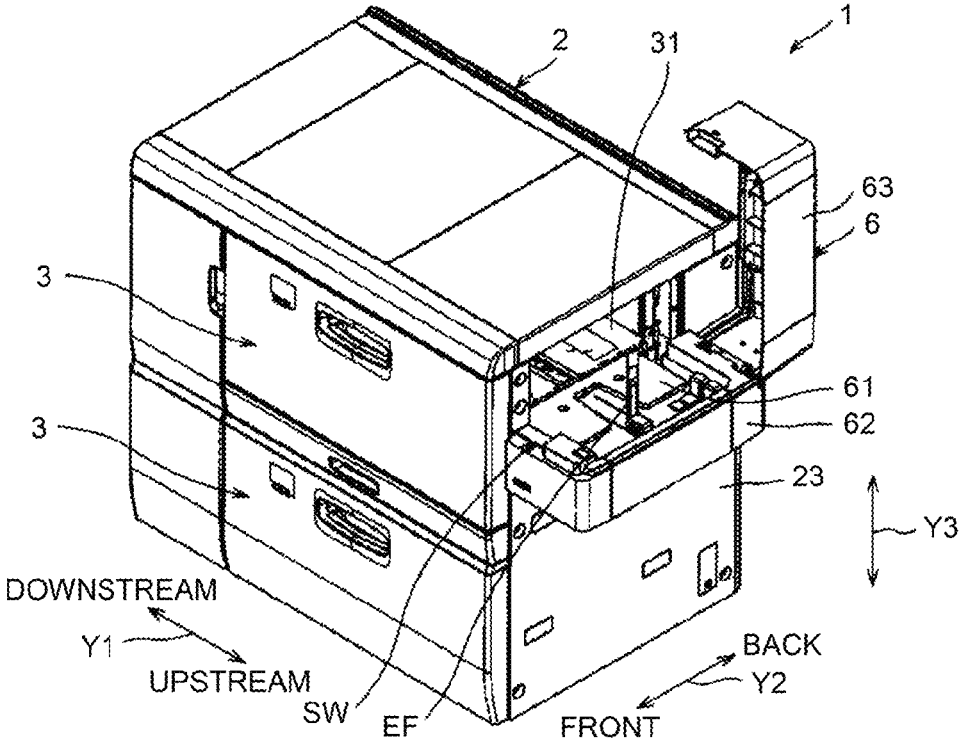
FIG. 3 is a perspective view illustrating the LCT with an openable cover of the optional extension unit illustrated in FIG. 2 open.
Figure 4:
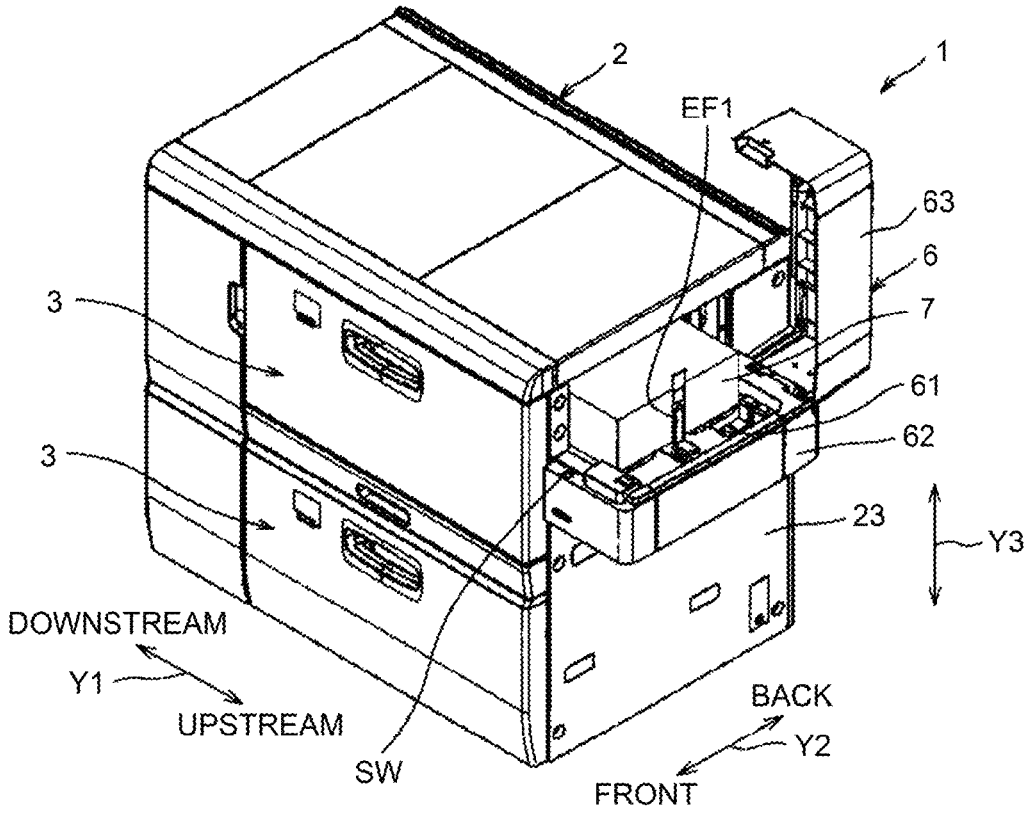
FIG. 4 is a perspective view illustrating the LCT illustrated in FIG. 3 with long sheets placed therein.

As illustrated in FIG. 1, the panels 22 and 23 are attached to the upper section and the lower section, respectively, on the upstream side of the casing 2 in the conveying direction Y1. The upper panel 22 is removably attached to the casing 2 with a screw. When the panel 22 is removed, as illustrated in FIGS. 3 and 4 and other drawings, the upstream side of the section of the casing 2 in the conveying direction Y1 where the upper sheet feeding tray 3 is housed is open. In this state, the optional extension unit 6, which will be described later, is attachable to the casing 2.

Figure 6A:
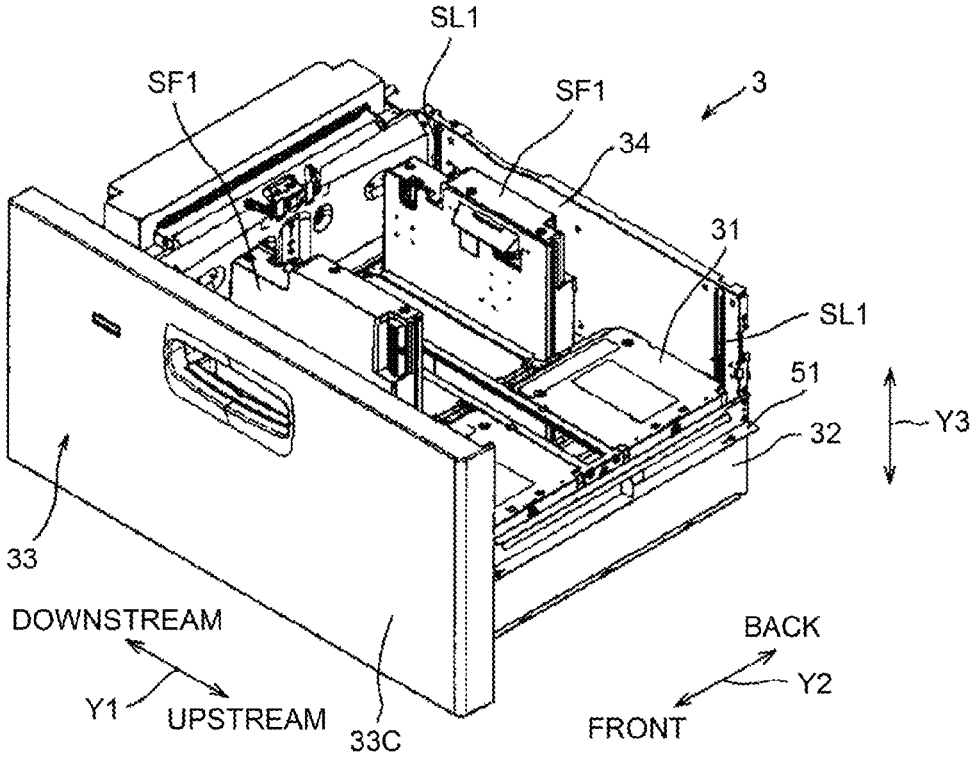
FIG. 6A is a perspective view of the sheet feeding tray included in the LCT illustrated in FIG. 1 as viewed from the front and FIG. 6B is a diagram illustrating the sheet feeding tray illustrated in FIG. 5A with an extension bottom plate attached thereto.

As illustrated in FIGS. 6A to 7B, the sheet feeding tray 3 includes the tray bottom plate 31, a bottom wall unit 32, a front-side wall unit 33, a back-side wall unit 34, and a downstream-side wall unit 35. The sheet feeding tray 3 is open at the top and the upstream side in the conveying direction Y1. As illustrated in FIGS. 6A and 6B, the extension bottom plate 61, which will be described later, is removably attachable to the upstream end of the tray bottom plate 31 in the conveying direction Y1.

Figure 11A:
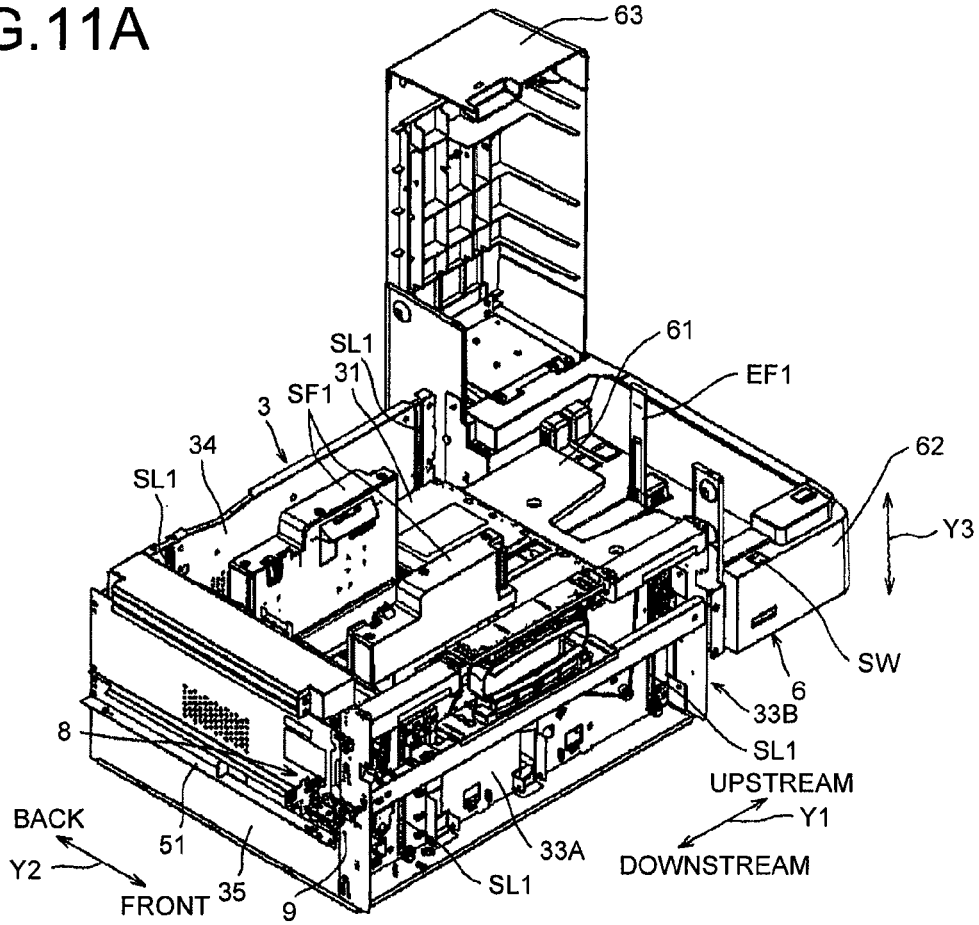
FIG. 11A is a perspective view illustrating the sheet feeding tray and the optional extension unit illustrated in FIG. 10B as viewed from the back and FIG. 11B is an enlarged partial view of a handle frame unit illustrated in FIG. 11A.

The bottom wall unit 32 is box-shaped and arranged below the tray bottom plate 31. A pair of side fences SF1 is arranged upright on the bottom wall unit 32 to define positional limits in the sliding direction Y2 of sheets stacked on the tray bottom plate 31. The front-side wall unit 33 is attached to a front edge of the bottom wall unit 32. As illustrated in FIG. 11A, the front-side wall unit 33 includes a main body 33A formed of a metal plate, a handle frame unit 33B attached to front side of the main body 33A, and a plastic exterior panel 33C (FIGS. 6A and 6B) that covers the main body 33A and the handle frame unit 33B from the front.

Figure 11B:
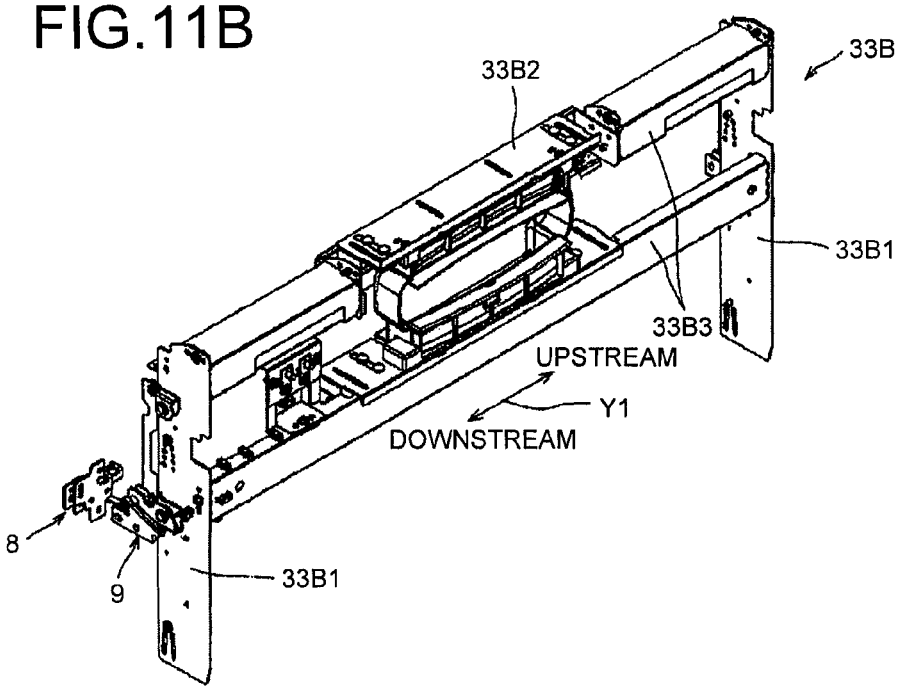

As illustrated in FIGS. 11A and 11B, the handle frame unit 33B includes a pair of frame plates 33B1 extending from the both edges of the main body 33A in the conveying direction Y1 frontward, a handle body 33B2 which is an example of slide operation unit, and support frames 33B3 that support the handle body 33B2. The handle body 33B2 is to be gripped by a user to perform a sliding operation to slide the sheet feeding tray 3 out from the casing 2. The pair of support frames 33B3 is supported between the pair of frame plates 33B1 to be separated from each other in a stacking direction Y3. The handle body 33B2 is supported between the pair of support frames 33B3.

The back-side wall unit 34 is formed of a metal plate and arranged upright along the back edge of the bottom wall unit 32 in the sliding direction Y2. The downstream-side wall unit 35 is formed of a metal plate and arranged upright along the downstream edge of the bottom wall unit 32 in the sliding direction Y2.

Figure 7A:
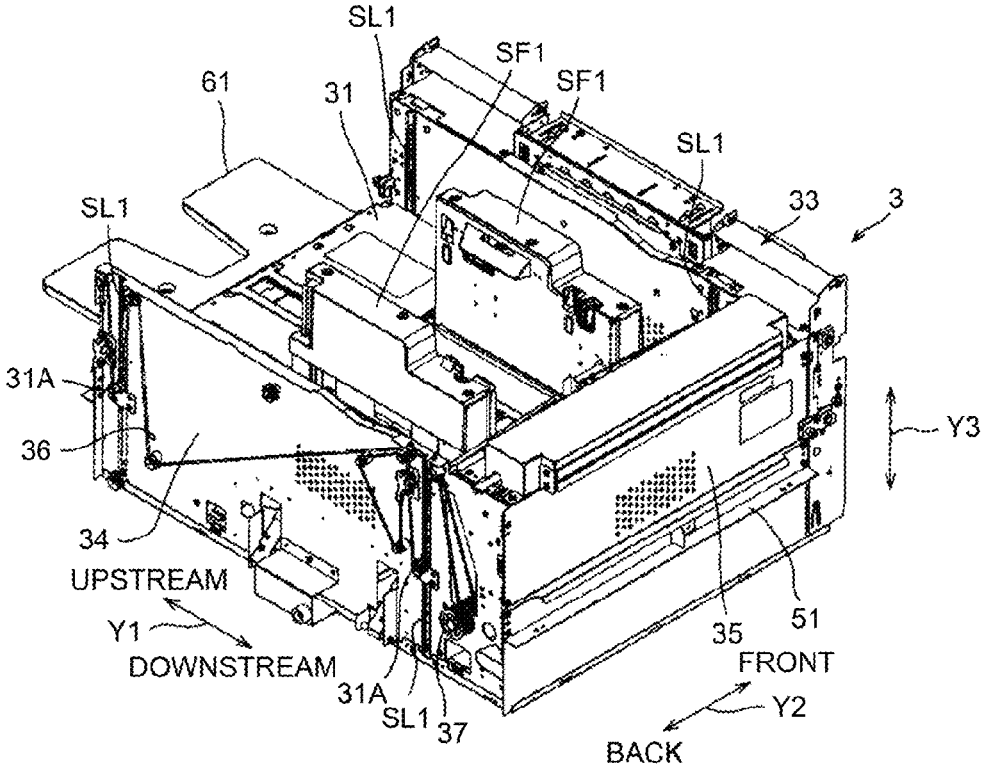
FIG. 7A is a perspective view illustrating the sheet feeding tray and the extension bottom plate illustrated in FIG. 6B as viewed from the back and FIG. 7B is an enlarged partial view of FIG. 7A.
Figure 7B:
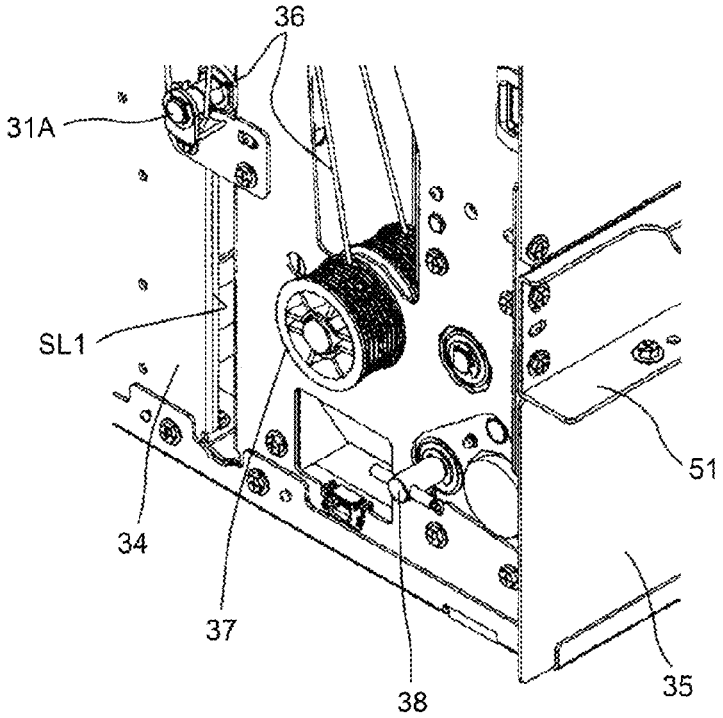
Figure 8:
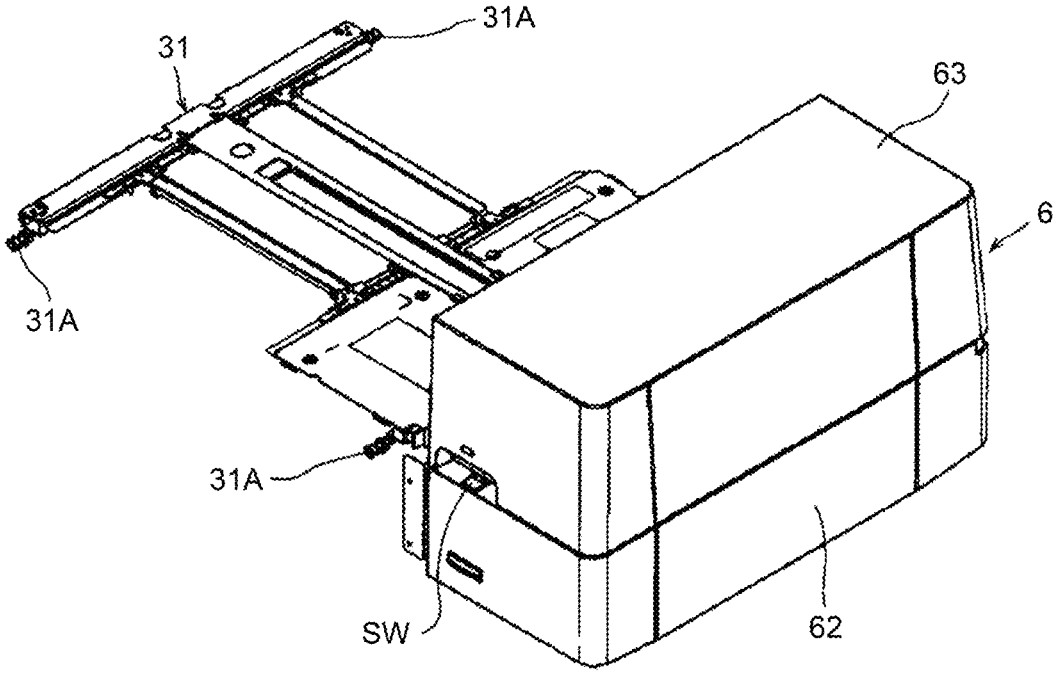
FIG. 8 is a perspective view illustrating a tray bottom plate and the optional extension unit included in the sheet feeding tray illustrated in FIGS. 6A and 6B.
Figure 9A:
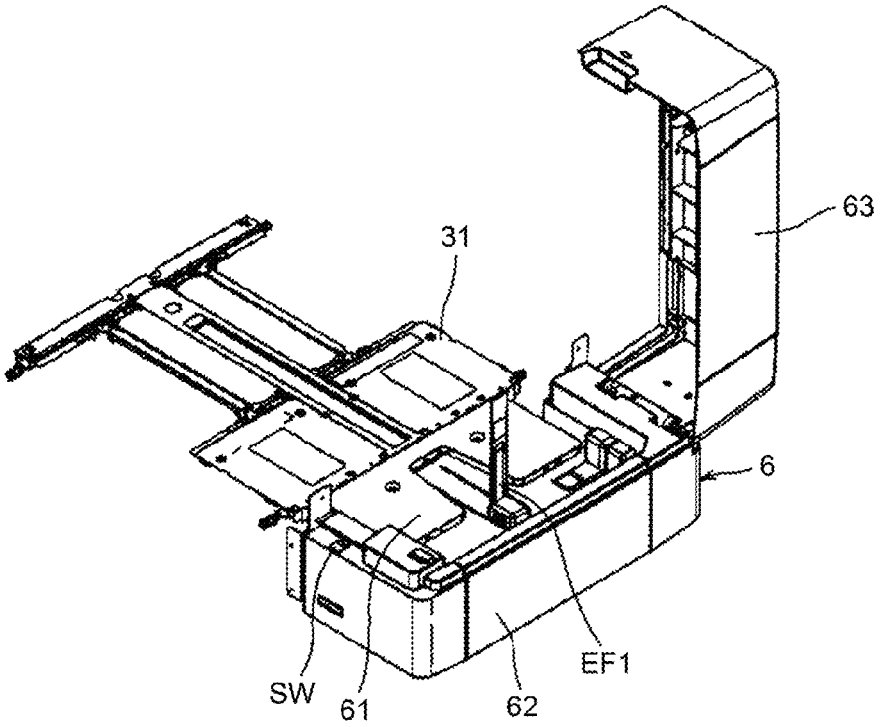
FIG. 9A is a perspective view illustrating the optional extension unit illustrated in FIG. 8 with the openable cover open and FIG. 9B is a perspective view illustrating the state where long sheets are stacked on the tray bottom plate and the optional extension unit illustrated in FIG. 9A.
Figure 9B:
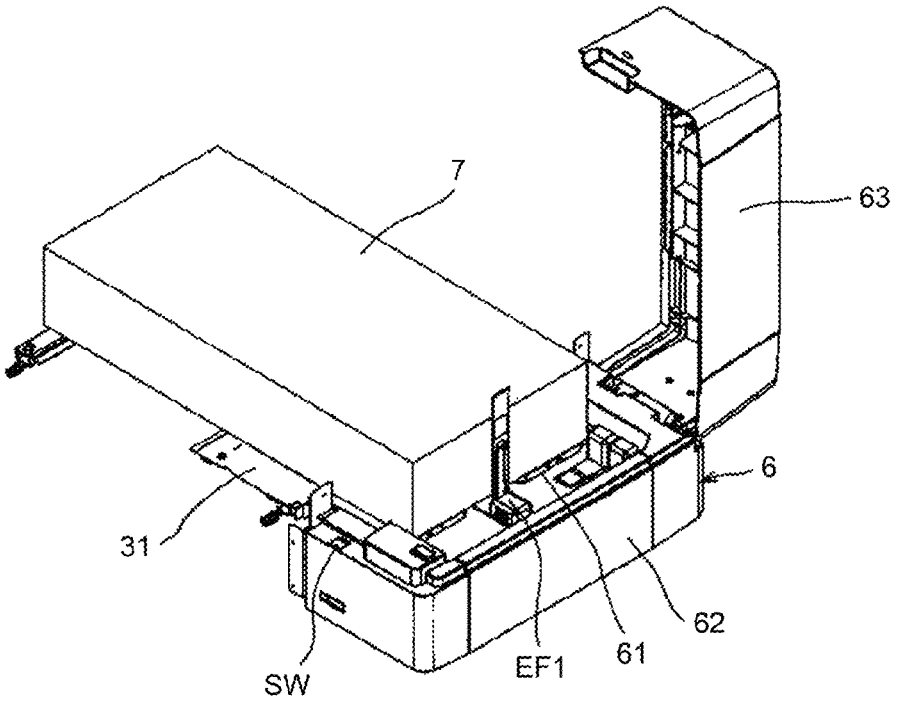
Figure 10A:
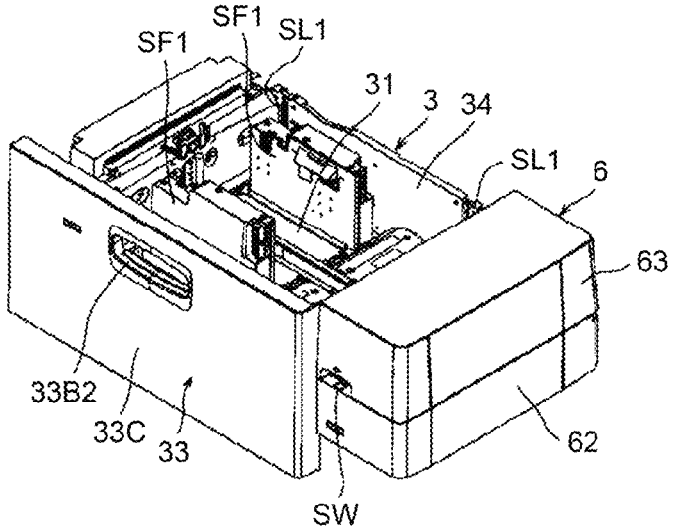
FIG. 10A is a perspective view illustrating the sheet feeding tray and the optional extension unit included in the LCT illustrated in FIG. 2.
Figure 10B:
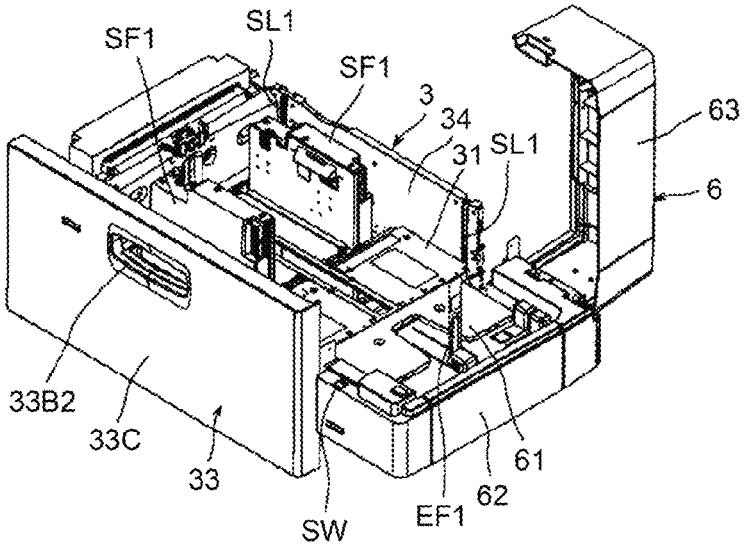
FIG. 10B is a perspective view of the same illustrated in FIG. 10A with the openable cover of the optional extension unit open.
Figure 10C:
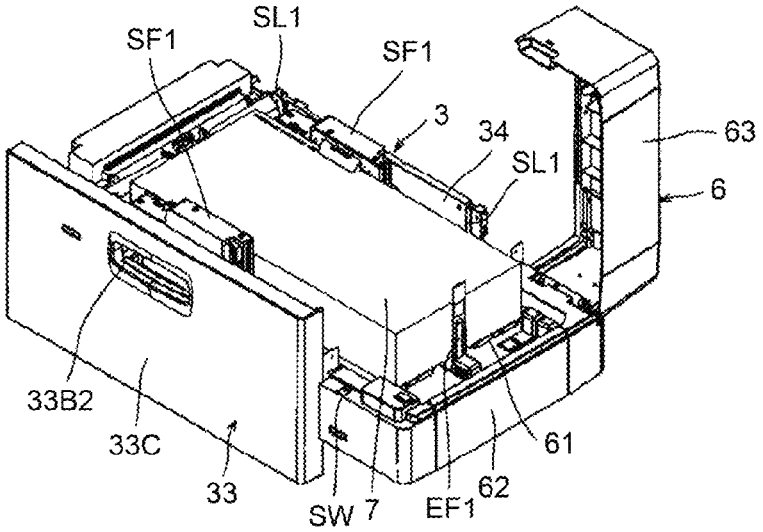
FIG. 10C is a perspective view illustrating the state where long sheets are stacked on the tray bottom plate and the optional extension unit illustrated in FIG. 10B.

As illustrated in FIGS. 7A and 7B, slits SL1 extending in the stacking direction Y3 to guide lift up/down of the tray bottom plate 31 are defined in the main body 33A of the front-side wall unit 33 and the back-side wall unit 34. Hanger units 31A (FIG. 8) disposed on the tray bottom plate 31 are inserted into the slits SL1.

As illustrated in FIGS. 7A and 7B, the sheet feeding tray 3 further includes wires 36 that suspend the tray bottom plate 31 in a manner that allows the tray bottom plate 31 to move in the stacking direction Y3, wire pulleys 37 that reel up the wires 36, and a bottom-plate elevating shaft 38. One of the wires 36 is extended across and supported on the main body 33A of the front-side wall unit 33, while the other is extended across and supported on the back-side wall unit 34, and the wires 36 are hooked by the hanger units 31A of the tray bottom plate 31, thereby suspending the tray bottom plate 31. The wire pulleys 37 lift up the tray bottom plate 31 by reeling up the wires 36, while lower the tray bottom plate 31 by unreeling the wires 36. The bottom-plate elevating shaft 38 projects backward from the back-side wall unit 34. A gear is interposed between the bottom-plate elevating shaft 38 and the wire pulley 37. When the bottom-plate elevating shaft 38 rotates, rotational torque thereof is transmitted via the gears to the wire pulleys 37, causing the wire pulleys 37 to rotate.

Figure 5A:
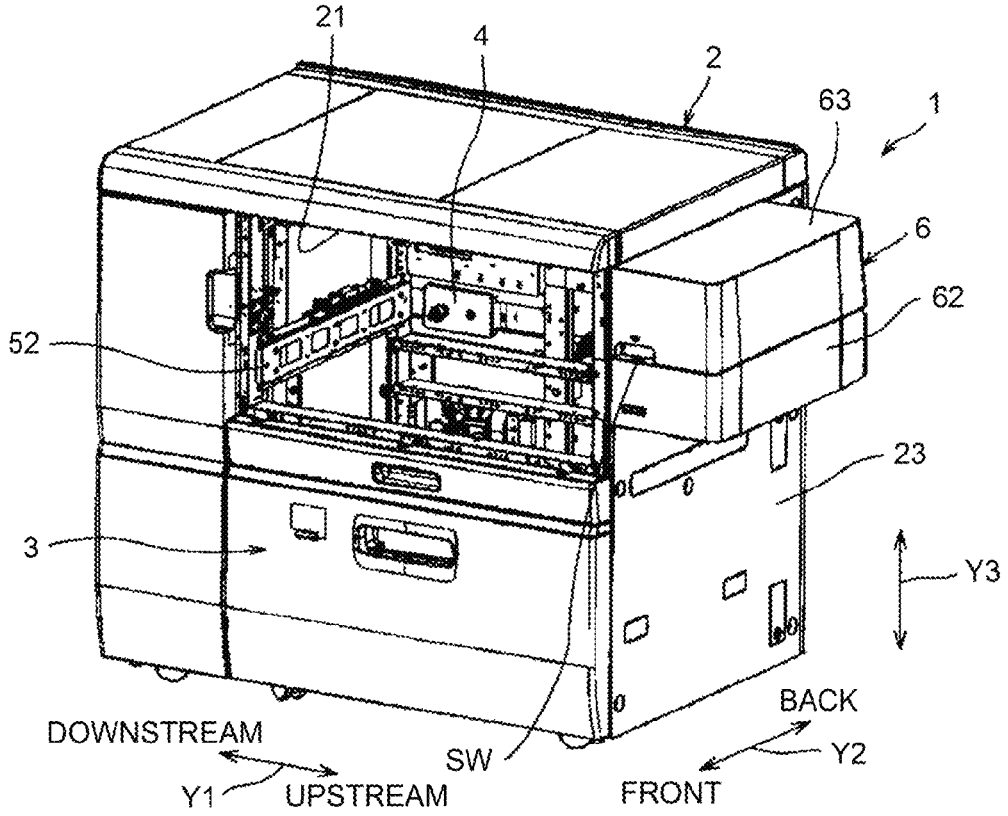
FIG. 5A is a perspective view illustrating the LCT illustrated in FIG. 2 with an upper one of sheet-feeding trays removed therefrom and FIG. 5B is an enlarged partial view of FIG. 5A.
Figure 5B:
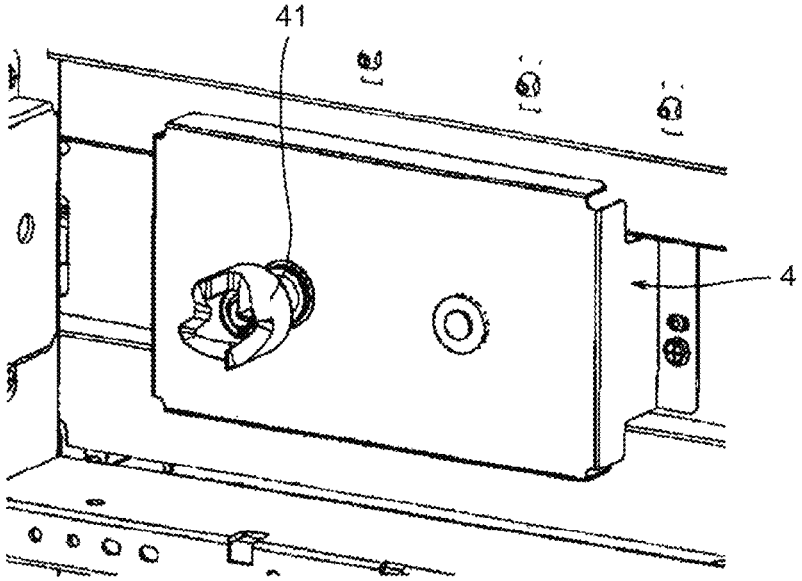

As illustrated in FIG. 5A, the drive unit 4 is attached to inside the casing 2. The drive unit 4 includes an elevation motor for lifting up/down the tray bottom plate 31 and a coupling 41 configured to couple to the bottom-plate elevating shaft 38 to thereby transmit rotational torque of the elevation motor to the bottom-plate elevating shaft 38. In a state where the sheet feeding tray 3 is housed in the casing 2, the coupling 41 couples to the bottom-plate elevating shaft 38, causing the bottom-plate elevating shaft 38 to be rotated by rotation of the coupling 41. Accordingly, in this state, the tray bottom plate 31 can be lifted up/down by rotation of the elevation motor.

Figure 6B:
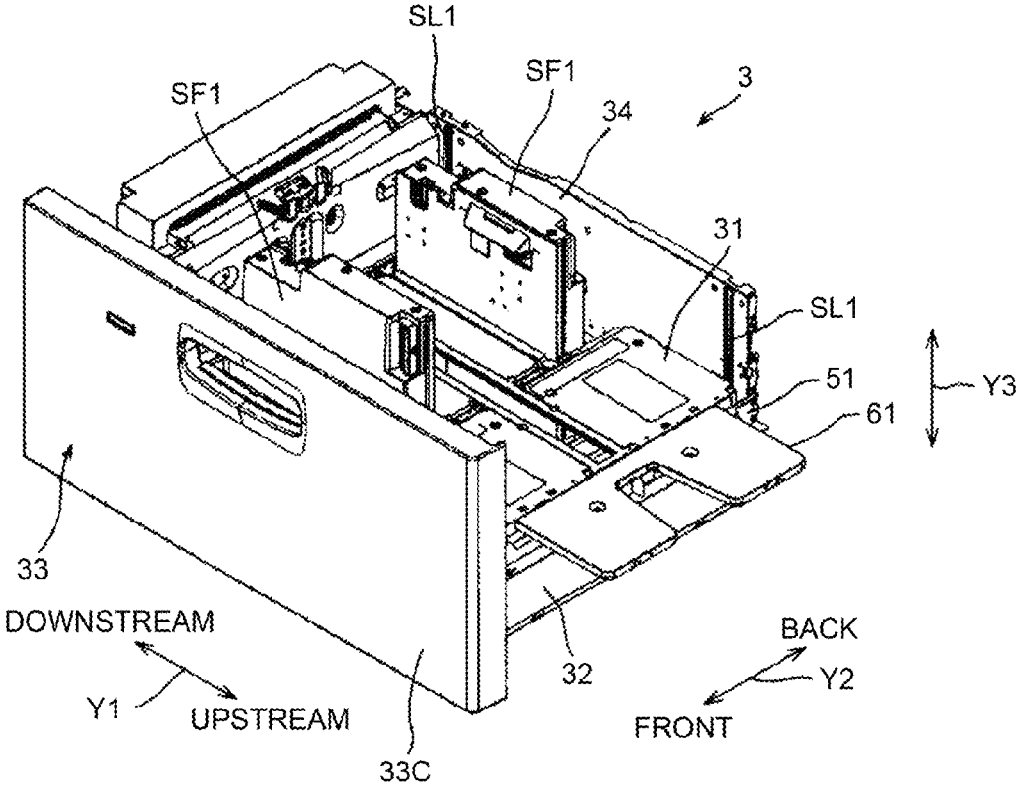

The pair of slide rails 51 (FIGS. 6A and 6B) and the pair of slide rails 52 (FIG. 5A) are configured to slidably join together and support the sheet feeding tray 3 at the upstream side and the downstream side in the conveying direction Y1. As illustrated in FIGS. 6A and 6B, the slide rails 51 of the pair are arranged on the downstream-side wall unit 35 and the upstream side surface of the bottom wall unit 32 of the sheet feeding tray 3 in the conveying direction Y1. As illustrated in FIG. 5A, the pair of slide rails 52 are attached to the casing 2.

The conveying unit includes the conveyance belt 12 (FIGS. 17A and 17B), which will be described later, and a conveyance motor that drives the conveyance belt 12 and the like. The conveying unit conveys the sheets stacked on the tray bottom plate 31 one at a time in the conveying direction Y1 orthogonal to both the sliding direction Y2 of the sheet feeding tray 3 and the stacking direction Y3 of the sheets.

The optional extension unit 6 includes the extension bottom plate 61, an extension-unit base 62 fixed to the casing 2, an end fence EF1, and an openable cover 63. The optional extension unit 6 is attached to the casing 2 with the panel 22 removed therefrom. More specifically, the extension bottom plate 61 is attached to the tray bottom plate 31 such that the extension bottom plate 61 projects from an opening that is provided by removing the panel 22 from the casing 2. The extension bottom plate 61 extends the tray bottom plate 31, thereby allowing the long sheets 7 to be stacked on the tray bottom plate 31.

The extension-unit base 62 is removably fixed to the casing 2 with a screw(s) or the like to be positioned on the bottom surface of the extension bottom plate 61. The end fence EF1 projects upward from the extension-unit base 62 to define a positional limit of the long sheets 7 in the conveying direction Y1 by pressing the upstream ends of the long sheets 7. The end fence EF1 includes a magnet at its basal portion at which the end fence EF1 is mounted on the extension-unit base 62. A metal plate, a magnet, or the like, to which the magnet is magnetically attracted, is disposed on the extension-unit base 62. This allows the end fence EF1 to be removably fixed at a desired position depending on the length of the long sheets 7.

A bottom-plate lowering switch SW which is an example of lower-to-limit operation unit to be operated to lower the tray bottom plate 31 to its lower limit position and an open/close detection switch that detects whether the openable cover 63, which will be described later, is open or closed are arranged on the extension-unit base 62. The openable cover 63 is arranged so as to cover the extension bottom plate 61 from above when the openable cover 63 is closed. The openable cover 63 is attached to be operable to open and close on a hinge provided on the extension-unit base 62 at the back in the sliding direction Y2. In a state where the optional extension unit 6 is attached, the long sheets 7 are placed in the sheet feeding tray 3 with the openable cover 63 open.

The LCT 1 includes first locking mechanisms 8 which are an example of first locking unit and second locking mechanisms 9 which are an example of second locking unit. The first locking mechanism 8 is a mechanism configured to be capable of being held in a first lock position where the sheet feeding tray 3 cannot be slid when the optional extension unit 6 is attached while, when the optional extension unit 6 is removed, held in a first unlock position where the sheet feeding tray 3 can be slid. The second locking mechanism 9 is a mechanism configured to move, in conjunction with operation performed using the handle body 33B2 described earlier, from a second lock position where the sheet feeding tray 3 cannot be slid to a second unlock position where the sheet feeding tray 3 can be slid.

The second locking mechanism 9 is described below prior to describing the first locking mechanism 8. As illustrated in FIGS. 11A to 14B, the second locking mechanism 9 is provided on the sheet feeding tray 3 at each of the both sides thereof in the conveying direction Y1. The second locking mechanism 9 includes a hook 91 fixed to the casing 2, a lock arm 92 attached to the handle frame unit 33B of the sheet feeding tray 3, and a linkage 93 that transmits a rotational torque produced by the operation using the handle body 33B2 to the lock arm 92.

A hook projection 91A projecting upward is formed on the hook 91. The hook projection 91A has a slope whose height gradually increases from the front to the back. The lock arm 92 includes a lock-arm body 92A, a lock projection 92B, a rotary shaft 92C, and a spring 92D.

The lock-arm body 92A includes a bottom plate 92A1 and a pair of vertical plates 92A2 extending upright from the both sides of the bottom plate 92A1 in the conveying direction Y1. The lock projection 92B is disposed to project from the vertical plate 92A2 nearer the hook 91 to be locked on the hook projection 91A. The rotary shaft 92C is fixed to the frame plates 33B1 of the sheet feeding tray 3 while extending through each of the pair of vertical plates 92A2 which are a part of the lock-arm body 92A. The lock-arm body 92A configured in this manner is attached to the frame plate 33B1 to be rotatable about the rotary shaft 92C. Hence, the lock projection 92B is movable between the second lock position (FIGS. 12A and 12B and 14A and 14B) where the lock projection 92B is locked by the hook projection 91A and the second unlock position where the lock projection 92B is positioned above the hook projection 91A and disengaged from the locking engagement.

The spring 92D is wound around the rotary shaft 92C with one end of the spring 92D fixed to the lock-arm body 92A and the other end fixed to a screw 10 projecting out from the frame plate 33B1. The spring 92D urges the lock-arm body 92A to the second lock position where the lock projection 92B is locked by the hook projection 91A. The back portion of the vertical plate 92A2 at the frame plate 33B1 is coupled to the linkage 93. Accordingly, when the handle body 33B2 is operated, the back portion of the vertical plates 92A2 is pulled upward via the linkage 93, placing the lock projection 92B in the second unlock position.

The configuration described above places the second locking mechanism 9 in the second lock position where the sheet feeding tray 3 cannot be slid when the handle body 33B2 is not operated. This is because the urging force of the spring 92D brings the lock projection 92B and the hook projection 91A into locking engagement as illustrated in FIGS. 12A and 12B and 14A and 14B. On the other hand, when the handle body 33B2 is operated to pull the sheet feeding tray 3 out from the casing 2, the lock projection 92B is placed in the second unlock position, making the sheet feeding tray 3 slidable. When the sheet feeding tray 3 is slid from outside the casing 2 into the casing 2, the lock projection 92B is pushed upward by the hook projection 91A, and, when the sheet feeding tray 3 slid backward in the sliding direction Y2 past the hook projection 91A, is urged by the force exerted by the spring 92D to the second lock position and locked.

The first locking mechanism 8 is described below. The first locking mechanism 8 includes a fixed bracket 81, a movable bracket 82 which is an example of lock piece, and a coupling spring 83 which is an example of urging unit. The fixed bracket 81 is formed of a metal plate or the like and fixed to the frame of the casing 2 with a screw N1 so that the fixed bracket 81 is orthogonal to the sliding direction Y2. Two pins P each having a distal end projecting toward the movable bracket 82, which will be described later, are attached to the fixed bracket 81. The two pins P are arranged in the conveying direction Y1. A joint portion 81A that is bent toward the movable bracket 82, which will be described later, is arranged on the fixed bracket 81.

The movable bracket 82 is formed of a metal plate, interposed between the frame of the casing 2 and the fixed bracket 81, and attached to the fixed bracket 81 to be slidable in the conveying direction Y1. The movable bracket 82 includes a fixed locking craw 82A bent toward the front, an elongated hole 82B into which the distal ends of the pins P arranged on the fixed bracket 81 are inserted to be slidable in the conveying direction Y1, and a joint portion 82C bent backward. The elongated hole 82B is elongated in the conveying direction Y1 to guide motion of the movable bracket 82 in the conveying direction Y1.

As configured as described above, the movable bracket 82 is movable between the first lock position (FIGS. 12B and 14B) where the fixed locking craw 82A is positioned above the lock projection 92B in locking engagement with the lock projection 92B and the first unlock position (FIGS. 12A and 14A) where the fixed locking craw 82A is separated from the lock projection 92B and disengaged from locking engagement with the lock projection 92B. With the fixed locking craw 82A in the first lock position, the lock projection 92B is prevented from rising even if the handle body 33B2 is operated. Accordingly, because locking engagement between the lock projection 92B and the hook projection 91A is not disengaged, the sheet feeding tray 3 cannot be slid. On the other hand, with the fixed locking craw 82A in the first unlock position, the lock projection 92B rises when the handle body 33B2 is operated. As a result, because locking engagement between the lock projection 92B and the hook projection 91A is disengaged, the sheet feeding tray 3 can be slid.

The coupling spring 83 is fixed at its one end to the joint portion 81A of the fixed bracket 81 and at the other end to the joint portion 82C of the movable bracket 82. The coupling spring 83 urges the movable bracket 82 to the first unlock position.

Figure 12A:
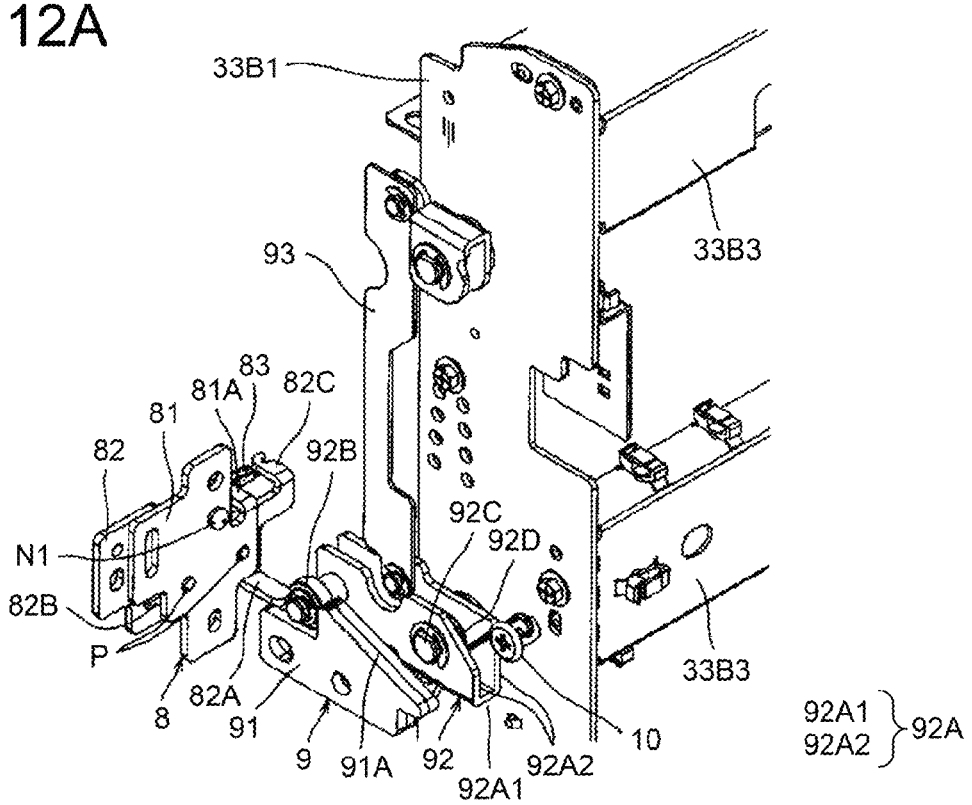
FIG. 12A is an enlarged partial view of FIG. 11B with a first locking mechanism in a first unlock position and FIG. 12B is an enlarged partial view of FIG. 11B with the first locking mechanism in a first lock position.
Figure 12B:
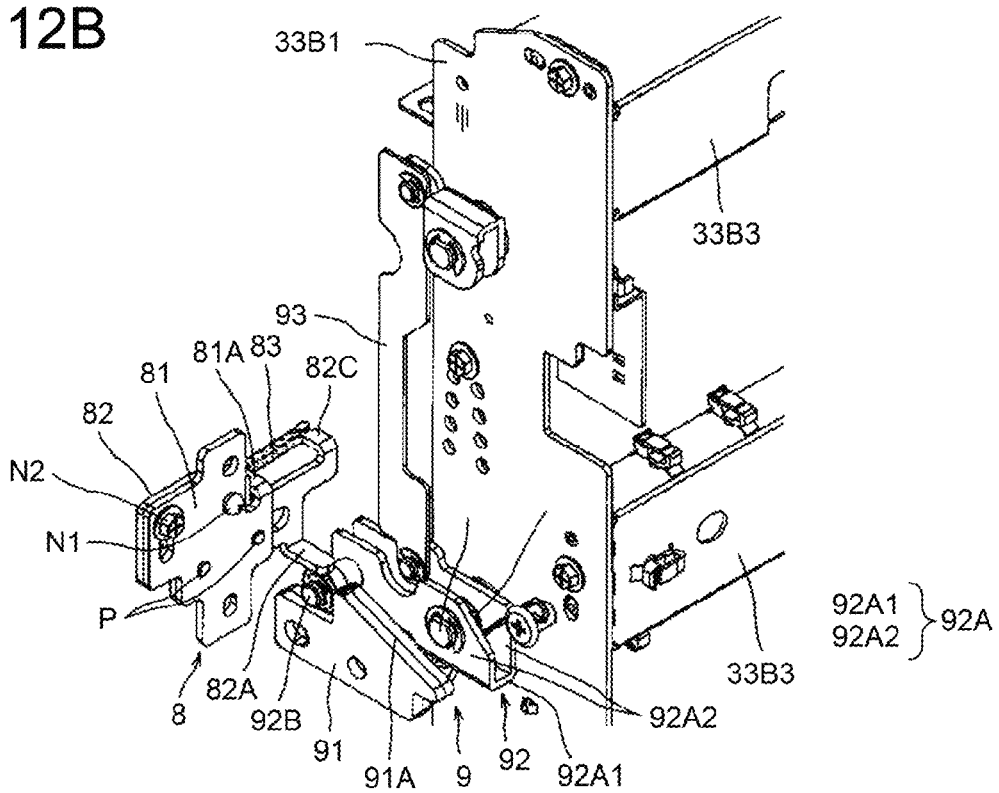
Figure 13A:
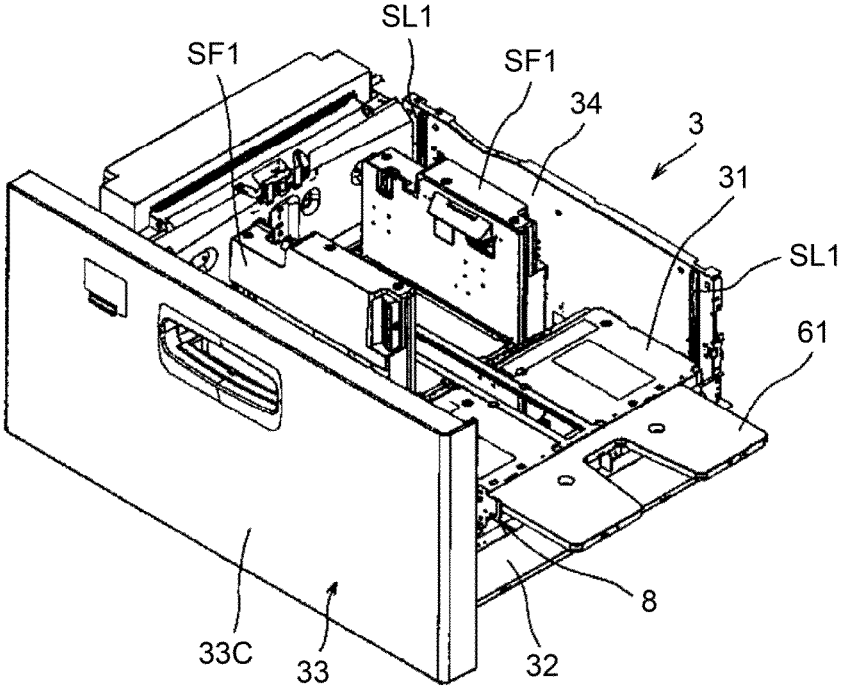
FIG. 13A is a perspective view of the sheet feeding tray illustrated in FIG. 1 and the first locking mechanism and FIG. 13B is a perspective view of the same illustrated in FIG. 13A with an exterior panel removed from the sheet feeding tray.
Figure 13B:
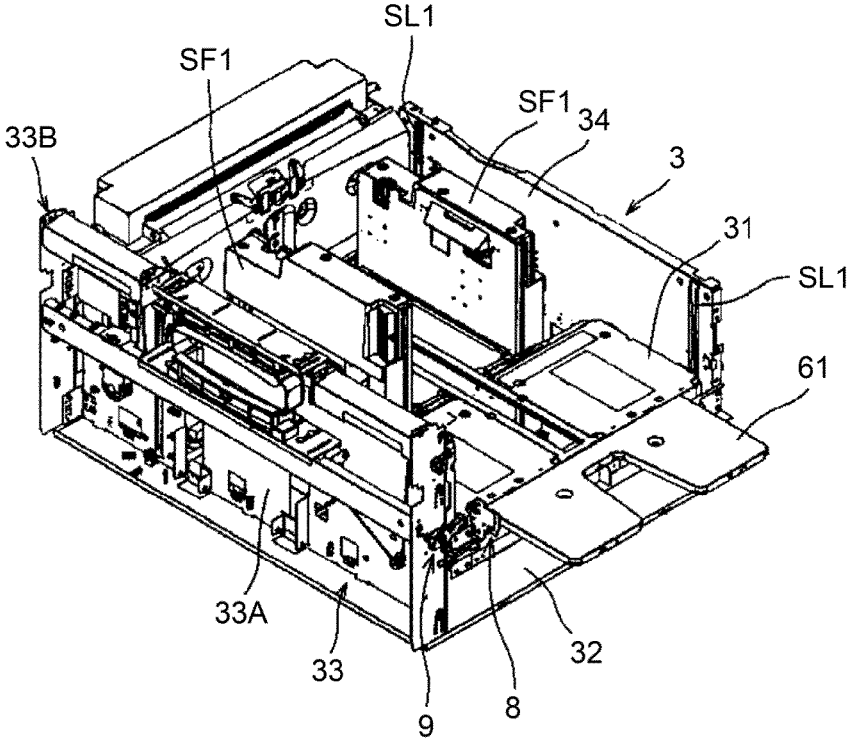
Figure 14A:
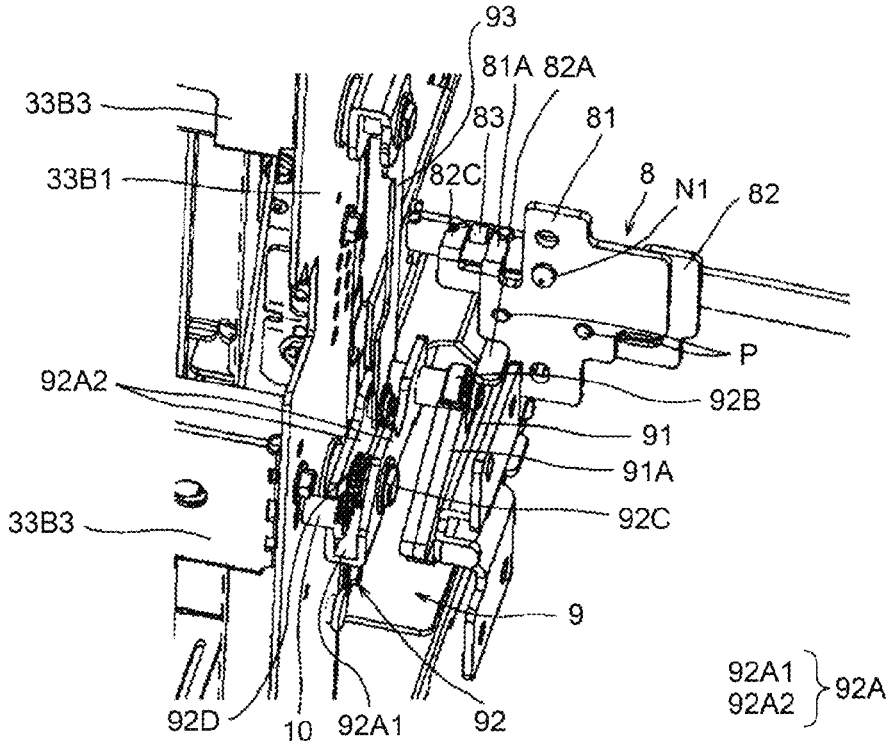
FIG. 14A is an enlarged partial view of FIG. 13B with the first locking mechanism in the first unlock position and FIG. 14B is an enlarged partial view of FIG. 13B with the first locking mechanism in the first lock position.
Figure 14B:
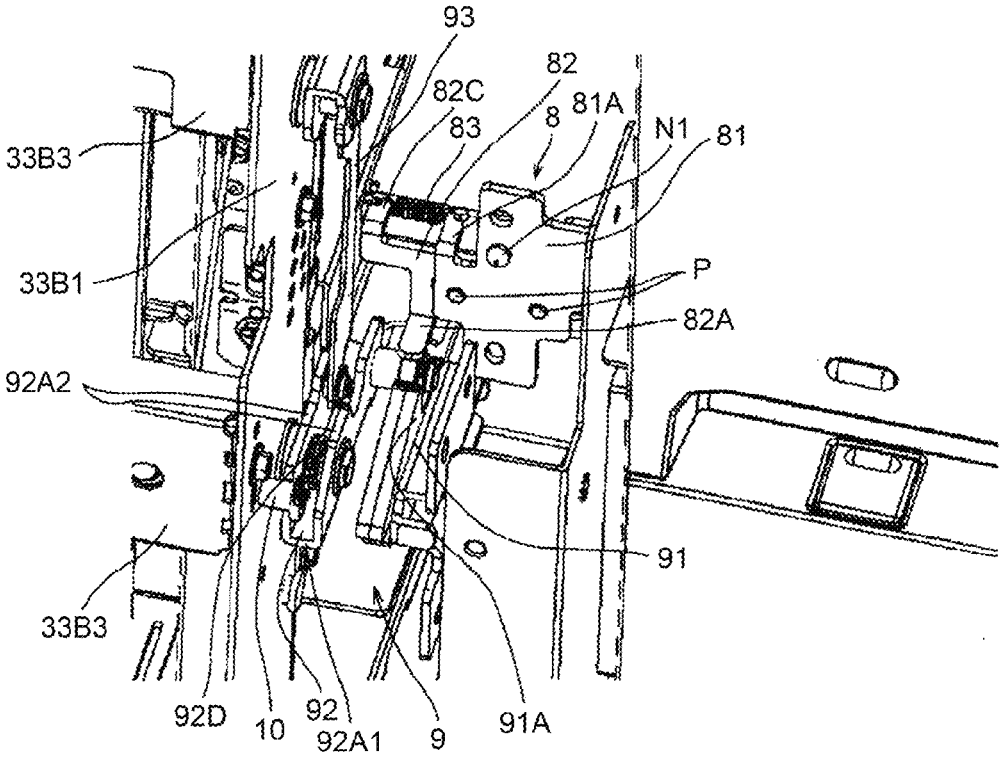

The first locking mechanism 8 at the downstream side in the conveying direction Y1 can be held in the first lock position by fastening, using a screw N2, the movable bracket 82 that is slid toward the sheet feeding tray 3 as illustrated in FIG. 12B. In contrast thereto, the first locking mechanism 8 at the upstream side in the conveying direction Y1 can be held in the first lock position by being pushed by the optional extension unit 6 in the state where the optional extension unit 6 is attached as illustrated in FIGS. 14A and 14B.

An electrical configuration of the LCT 1 described above is described below. The LCT 1 includes a CPU (central processing unit) which is an example of control unit providing overall control of the LCT 1. On/off of the bottom-plate lowering switch SW and the open/close switch are fed to the CPU. The CPU controls driving of the elevation motor of the drive unit 4 and the conveyance motor of the conveying unit described above.

How the LCT 1 described above operates is described below. When stacking standard-size sheets on the sheet feeding tray 3, the optional extension unit 6 is removed, and the upstream side of the casing 2 in the conveying direction Y1 is closed with the panel 22 as illustrated in FIG. 1. In this state, the movable bracket 82 of the first locking mechanism 8 is held in the first unlock position by the urging force exerted by the coupling spring 83 as illustrated in FIG. 12A. Accordingly, when the handle body 33B2 is operated, locking engagement between the lock projection 92B and the hook projection 91A is disengaged, and the sheet feeding tray 3 can be pulled out from the casing 2, so that the standard-size sheets can be stacked. How to stack the long sheets 7 on the sheet feeding tray 3 is described below. An optional unit installing person (e.g., a customer engineer) slides the movable bracket 82 of the first locking mechanism 8 at the downstream side in the conveying direction Y1 toward the sheet feeding tray 3 as illustrated in FIG. 12B and fastens the movable bracket 82 with the screw N2.

Hence, the fixed locking craw 82A is held in the first lock position where it locks the lock projection 92B. The optional unit installing person then removes the panel 22 from the casing 2 and attaches the optional extension unit 6. More specifically, the optional unit installing person attaches the extension bottom plate 61 to the tray bottom plate 31 and attaches the extension-unit base 62 to the casing 2. As a result, the movable bracket 82 of the first locking mechanism 8 at the upstream side in the conveying direction Y1 is pushed by the optional extension unit 6 to slide toward the sheet feeding tray 3 as illustrated in FIG. 14B.

Accordingly, the first locking mechanism 8 at the upstream side in the conveying direction Y1 is held in the first lock position where the fixed locking craw 82A locks the lock projection 92B. Even if, in this state, an attempt of pulling the handle body 33B2 is made, the sheet feeding tray 3 remains in the state where it cannot be slid because the fixed locking craw 82A and the lock projection 92B are in locking engagement.

In the state where the optional extension unit 6 is attached, the long sheets 7 are to be placed through the opening at the upstream side in the conveying direction Y1 provided by opening the openable cover 63 as illustrated in FIGS. 3 and 4. On the other hand, in the state where the optional extension unit 6 is not attached, sheets are placed in the sheet feeding tray 3 that is slid out from the casing 2 as described earlier. In this state, coupling between the coupling 41 and the bottom-plate elevating shaft 38 is disengaged, causing the tray bottom plate 31 to fall to its lower-limit position by the pull of gravity.

In contrast thereto, in the state where the optional extension unit 6 is attached, the sheet feeding tray 3 is not slid out from the casing 2. Accordingly, coupling between the coupling 41 and the bottom-plate elevating shaft 38 is not disengaged, and therefore the tray bottom plate 31 does not fall to its lower-limit position by the pull of gravity, which prevents the long sheets 7 from being stacked. However, according to the first embodiment, the CPU performs operations illustrated in FIGS. 15A and 15B if the optional extension unit 6 is attached, thereby lowering the tray bottom plate 31 to its lower-limit position when the long sheets 7 are to be stacked.

Figure 15A:
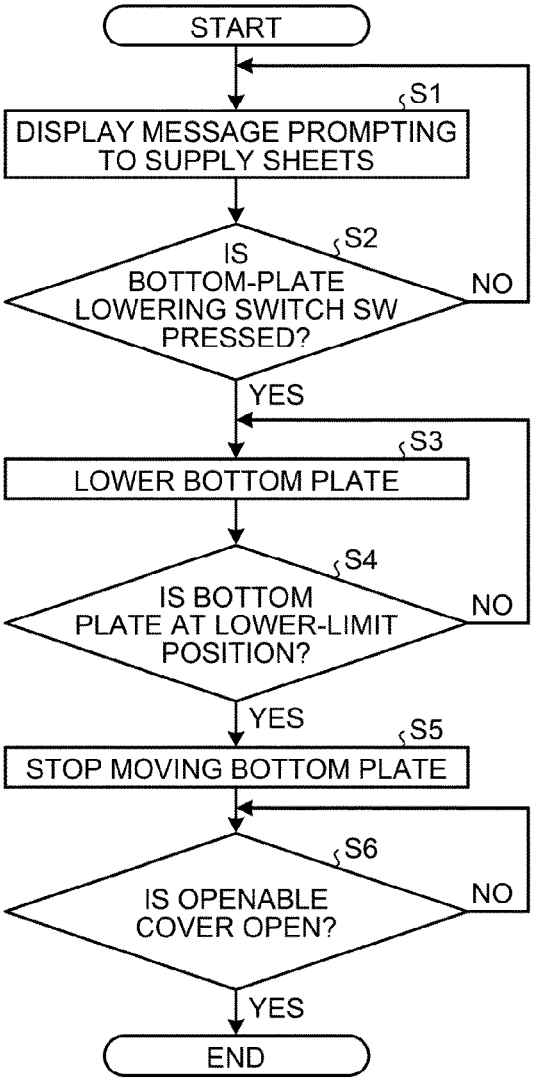
FIGS. 15A and 15B are flowcharts illustrating procedures for processes to be performed by a CPU included in the LCT.

The CPU starts the operation illustrated in FIG. 15A when the long sheet 7 in the tray bottom plate 31 runs out. The CPU causes a message prompting to supply sheets to be displayed on a liquid crystal display in the image forming unit as illustrated in FIG. 16, for example (Step S1). At this time, a message prompting to press the bottom-plate lowering switch SW may be displayed. When the bottom-plate lowering switch SW is pressed by a user to supply the long sheets 7 (YES at Step S2), the CPU drives the elevation motor to thereby lower the tray bottom plate 31 (Step S3). Thereafter, when it is detected that the tray bottom plate 31 has reached the lower-limit position (YES at Step S4), the CPU causes the elevation motor to stop driving, thereby stopping moving the tray bottom plate 31 (Step S5). Thereafter, the CPU waits for a user to open the openable cover 63 to supply the long sheets 7 (YES at Step S6). Then, the operation ends. Thereafter, the CPU starts the operation illustrated in FIG. 15B.

Figure 15B:
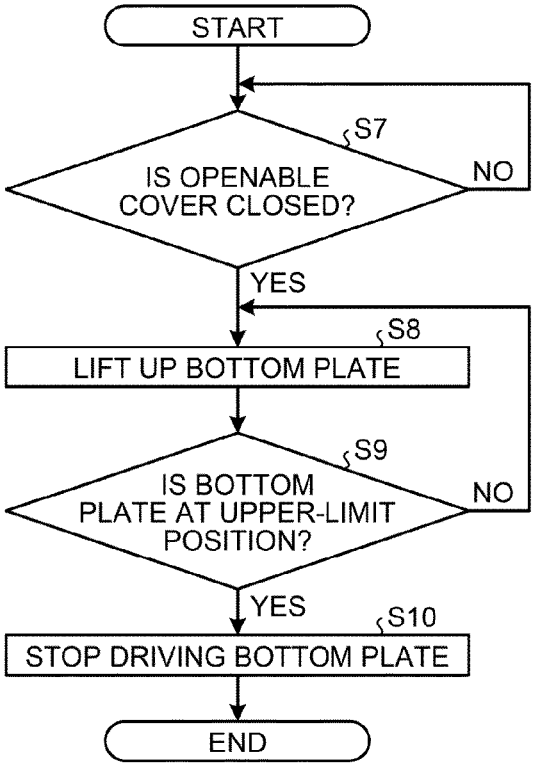
Figure 16:
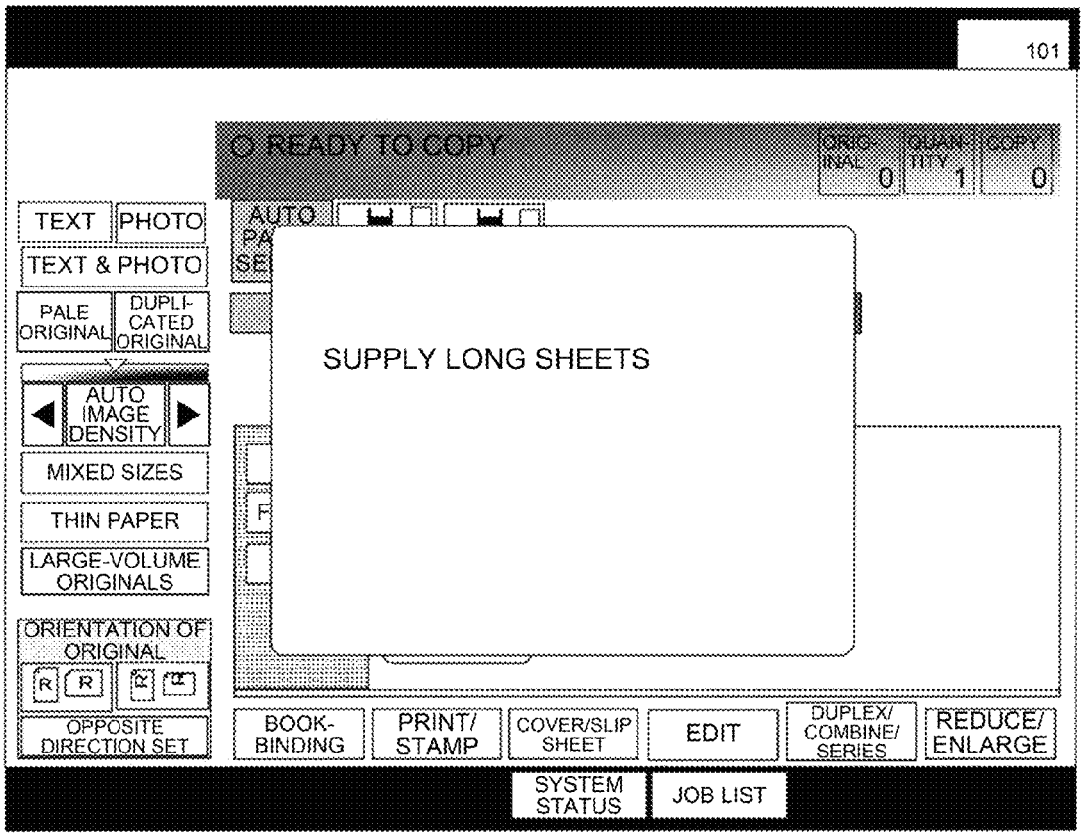
FIG. 16 is a diagram illustrating an example of a screen to be displayed on a liquid crystal display at Step S1 of FIG. 15A.

In the operation illustrated in FIG. 15B, the CPU determines whether or not the openable cover 63 is closed (Step S7). Upon detecting that the long sheets 7 are supplied by a user and the openable cover 63 is closed (YES at Step S7), the CPU drives the elevation motor to lift up the tray bottom plate 31 (Step S8). Thereafter, the CPU determines whether or not the tray bottom plate 31 has reached to its upper-limit position where the conveying unit can convey a sheet (Step S9). If the tray bottom plate 31 has reached the upper-limit position (YES at Step S9), the CPU causes the elevation motor to stop driving, thereby stopping driving the tray bottom plate 31 (Step S10). Then, the operation ends.

According to the embodiment described above, the first locking mechanism 8 can be held in the first lock position where the sheet feeding tray 3 cannot be slid when where the optional extension unit 6 is attached while, when the optional extension unit 6 is removed, held in the first unlock position where the sheet feeding tray 3 can be slid. With this, if the first locking mechanism 8 is held in the first lock position in the state where the optional extension unit 6 is attached, even if a user attempts to slide the sheet feeding tray 3 by mistake, because the sheet feeding tray 3 is locked by the first locking mechanism 8 and prevented from sliding, the extension bottom plate 61 is protected from being damaged.

According to the embodiment described above, when the first locking mechanism 8 is in the first lock position, the first locking mechanism 8 locks and prevents the second locking mechanism 9 from moving from the second lock position to the second unlock position, thereby non-slidably locking the sheet feeding tray 3. Accordingly, the first locking mechanism 8 can be implemented in a simple structure.

According to the embodiment described above, the first locking mechanism 8 at the upstream side in the conveying direction Y1 is pushed by the optional extension unit 6 to move from the first unlock position to the first lock position. Accordingly, an undesirable situation that an optional unit installing person forgets to lock the sheet feeding tray 3 is prevented, and installation work is facilitated.

According to the embodiment described above, the first locking mechanism 8 includes the movable bracket 82 movable between the first lock position where the sheet feeding tray 3 cannot be slid and the first unlock position where the sheet feeding tray 3 can be slid and the coupling spring 83 that urges the movable bracket 82 to a first unlock state. This facilitates the installation work because, in the state where the optional extension unit 6 is not attached, the sheet feeding tray 3 is not locked by the movable bracket 82.

According to the embodiment described above, when the bottom-plate lowering switch SW is operated, the CPU drives the tray bottom plate 31 to the lower-limit position, but lifts up the tray bottom plate 31 to the upper-limit position when the openable cover 63 is closed from an open state. This allows, even when coupling between the coupling 41 and the bottom-plate elevating shaft 38 is cannot disengaged because the optional extension unit 6 is attached, the long sheets 7 to be supplied by moving the tray bottom plate 31 to the lower-limit position.

According to the first embodiment described above, the first locking mechanism 8 is provided on each of the both sides of the sheet feeding tray 3 in the conveying direction Y1. Accordingly, even if the handle body 33B2 should be operated by mistake in the state where the optional extension unit 6 is attached, the force exerted in operating the handle body 33B2 can be distributed. As a result, the mechanism that facilitate the locking is achieved.

According to the first embodiment described above, the optional extension unit 6 is attached only to the upper one of the sheet feeding trays 3 housed in the upper and lower sections of the casing 2; however, example embodiments are not limited thereto. For instance, a modification in which the optional extension units 6 can be attached to the respective sheet feeding trays 3 arranged in the vertically-stacked arrangement may be employed. This modification in which the plurality of optional extension units 6 can be attached allows the long sheets 7 of various sizes to be fed.

According to the first embodiment described above, the tray bottom plate 31 is lowered when the bottom-plate lowering switch SW is operated; however, example embodiments are not limited thereto. For instance, a modification in which, when the openable cover 63 is opened by a user to supply the long sheets 7, the CPU drives the elevation motor to lower the tray bottom plate 31 may be employed. Thereafter, as in the first embodiment, when the openable cover 63 is closed by a user after placing the long sheets 7, the CPU drives the elevation motor to lift up the tray bottom plate 31.

According to the first embodiment described above, the fixed locking craw 82A of the first locking mechanism 8 locks the lock projection 92B of the second locking mechanism 9; however, example embodiments are not limited thereto. A modification in which the fixed locking craw 82A locks a portion other than the lock projection 92B of the sheet feeding tray 3 may be employed.

According to the first embodiment described above, the movable bracket 82 at the upstream side in the conveying direction Y1 is held in the first lock position by being pushed by the optional extension unit 6 when the optional extension unit 6 is attached; however, example embodiments are not limited thereto. A modification in which the movable bracket 82 at the upstream side in the conveying direction Y1 is held in the first lock position by being fastened to the fixed bracket 81 with a screw as is the movable bracket 82 at the downstream side in the conveying direction Y1 may be employed.

Second Embodiment

A second embodiment of the present invention is described below. It is desired that such an LCT as the LCT 1 capable of holding the long sheets 7 be capable of printing on paper of a wide range of thicknesses from thin paper to thick paper. In particular, if air-assisted sheet feeding technique is used, problems described below can occur at printing on thin paper.

Figure 17A:
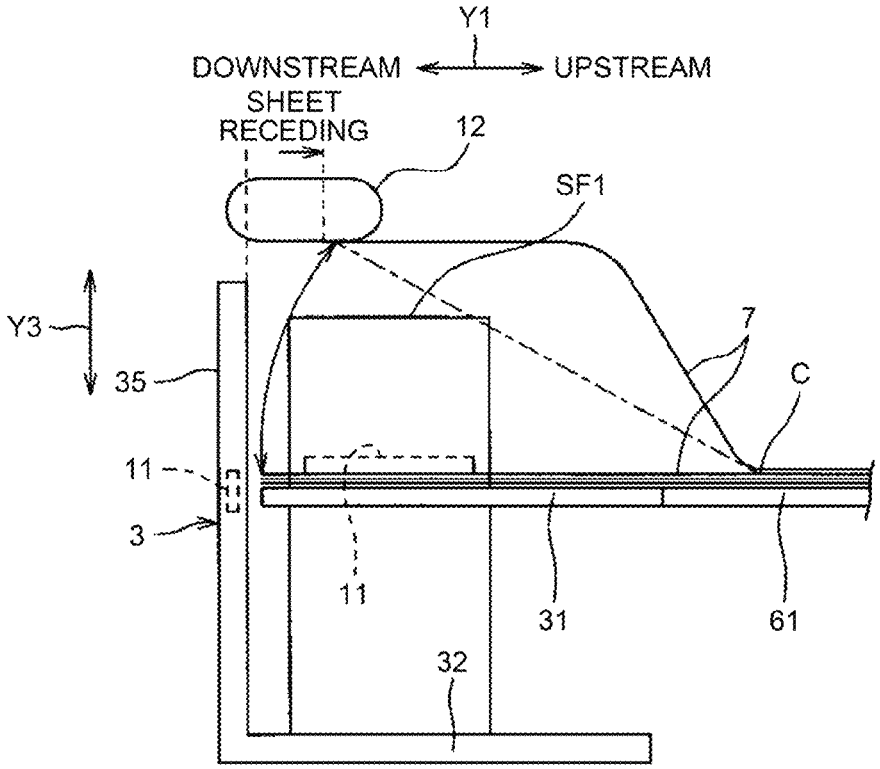
FIGS. 17A and 17B are explanatory diagrams for describing a schematic configuration and advantage of an LCT according to a second embodiment.
Figure 17B:
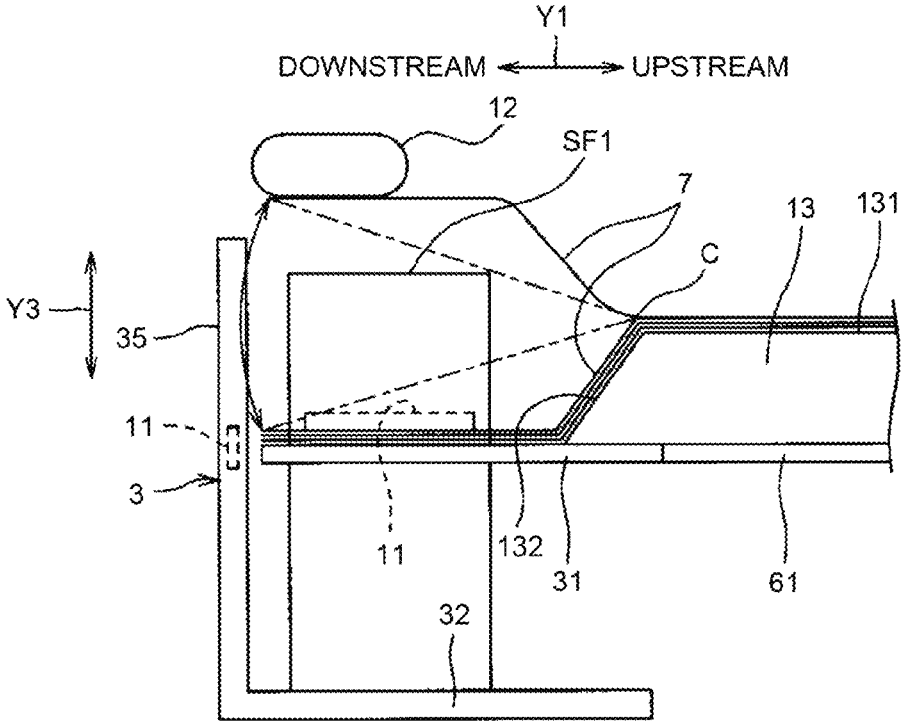
Figure 18:
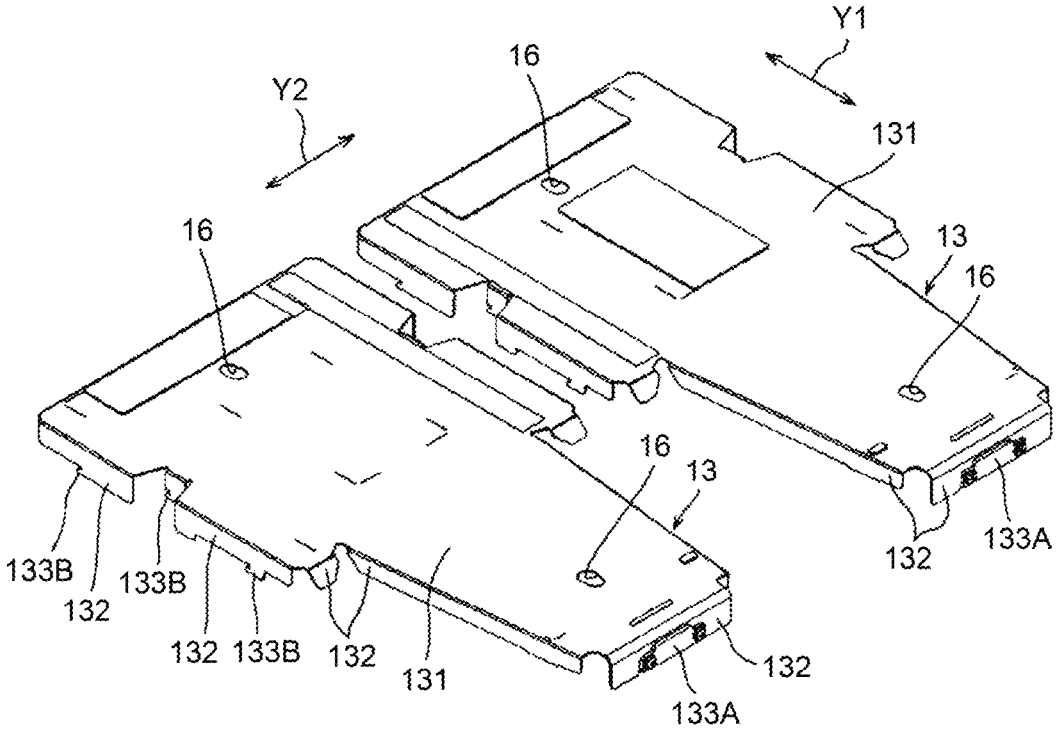
FIG. 18 is a top perspective view of a pair of bases illustrated in 17B.
Figure 19:
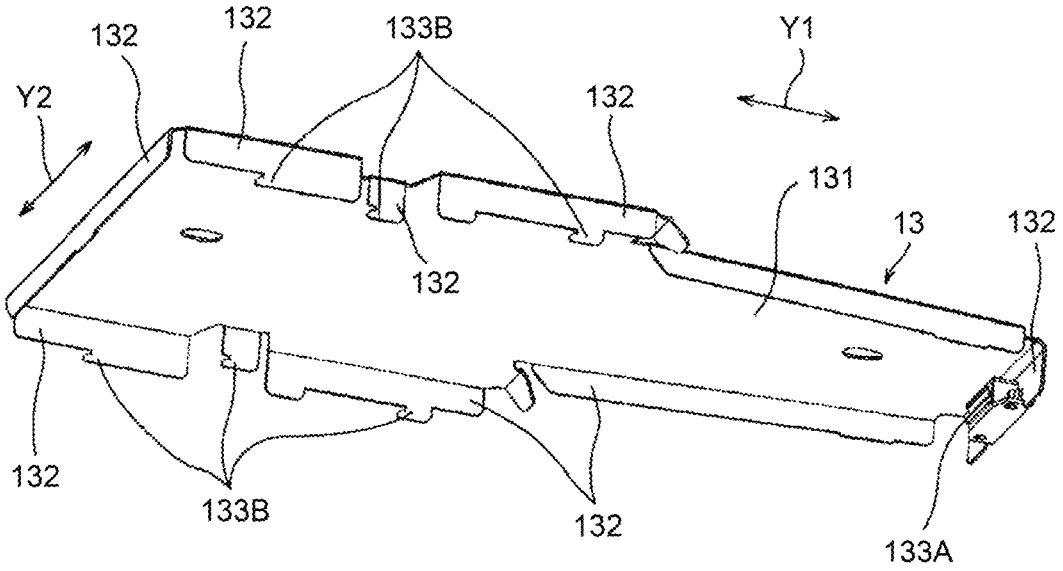
FIG. 19 is a bottom perspective view of the pair of bases illustrated in FIG. 18.
Figure 20:
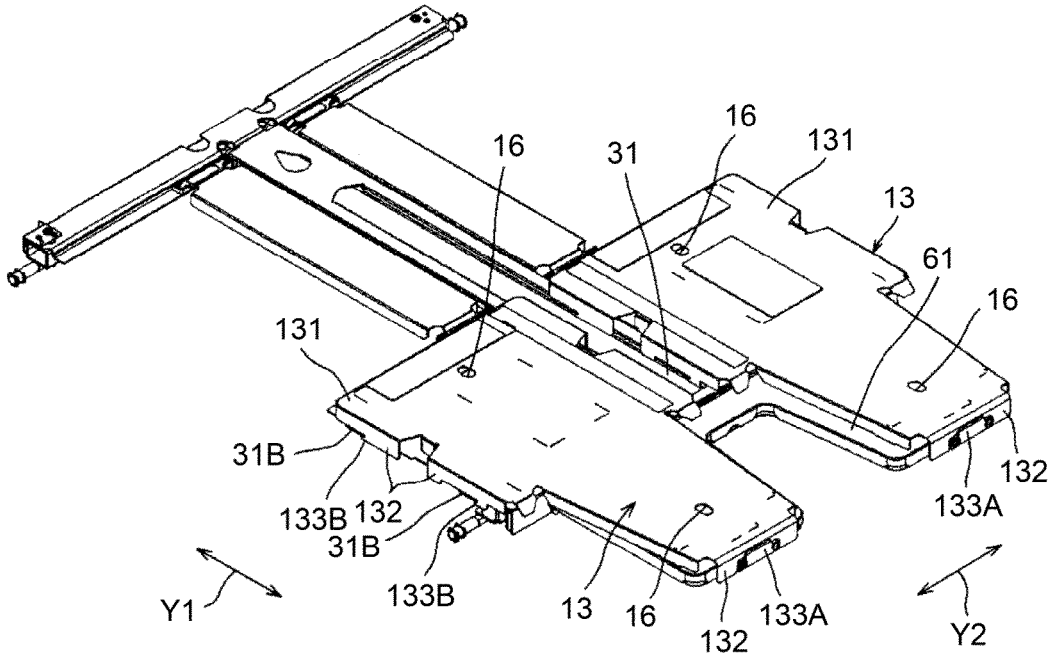
FIG. 20 is a perspective view of the tray bottom plate, the extension bottom plate, and the bases according to the second embodiment.

The air-assisted sheet feeding technique is typically performed by, as illustrated in FIGS. 17A and 17B, blowing air onto the long sheets 7 from air blowing units 11 built in the side fences SF1 and the downstream-side wall unit 35 of the sheet feeding tray 3, thereby lifting up the downstream ends of the long sheets 7 in the conveying direction Y1 toward the conveyance belt 12. The air blowing units 11 are an example of air blowing means. The conveyance belt 12 is an example of the conveying means. The conveyance belt 12 conveys the long sheet 7 attracted to the conveyance belt 12. At this time, as illustrated in FIG. 17A, the downstream end of the long sheet 7 in the conveying direction Y1 is lifted up in an arc shape centered on a center axis C which resides in the upstream portion of the long sheet 7. This can cause sheet receding, which is upstream shift of an attracting position of the long sheet 7, and undesirably result in multi-feed.

To overcome this disadvantage, the LCT 1 according to the second embodiment includes, in addition to the configuration already described in the first embodiment, a base 13 which is an example of height increasing unit removably mounted on the tray bottom plate 31 and the extension bottom plate 61 as illustrated in FIG. 17B. In the second embodiment, the base 13 is mounted upstream of the side fences SF1 with respect to the conveying direction Y1. By virtue of the base 13, the long sheets 7 can be stacked such that the upstream portion of the long sheets 7 in the conveying direction Y1 is at a higher level with respect to the stacking direction Y3 than the downstream portion in the conveying direction Y1.

The base 13 includes a table portion 131, on which the long sheets 7 are to be stacked, formed as a horizontal surface horizontal with the tray bottom plate 31 and vertical plate portions 132. The vertical plate portion 132 at the downstream portion in the conveying direction Y1 is tapered so as to approach the downstream side in the conveying direction Y1 toward the lower in the stacking direction Y3. With this, the long sheets 7 are stacked to have a profile having a step at a midpoint in the conveying direction Y1 and such that each of the upstream and downstream end portions of the long sheets 7 in the conveying direction Y1 are horizontally laid.

In the second embodiment, by virtue of the base 13, the center axis C of the long sheets 7 comes to reside near the downstream edge of the table portion 131 in the conveying direction Y1 as illustrated in FIG. 17B. As is apparent from comparison between FIGS. 17A and 17B, because the base 13 displaces the center axis C toward the conveyance belt 12, sheet receding of the long sheets 7 is prevented, and therefore multi-feed can be prevented.

The structure of the base 13 described above is described more specifically below with reference to FIGS. 18A to 22B. Elements illustrated in FIGS. 18A to 22B equivalent to those of the LCT 1 already described in the first embodiment illustrated in FIGS. 1 to 16 are denoted by like reference numerals and symbols, and repeated descriptions are omitted. A pair of the bases 13 that are identical in size and shape is mounted on the tray bottom plate 31 and the extension bottom plate 61. Each of the pair of bases 13 is formed by punching a metal plate. The bases 13 of the pair are arranged symmetrically about a center axis extending along the conveying direction Y1. Each of the pair of bases 13 includes the table portion 131 where the long sheets 7 are to be stacked and the vertical plate portions 132 extending downward, with respect to the stacking direction Y3, from outer edge of the table portion 131.

Figure 21:
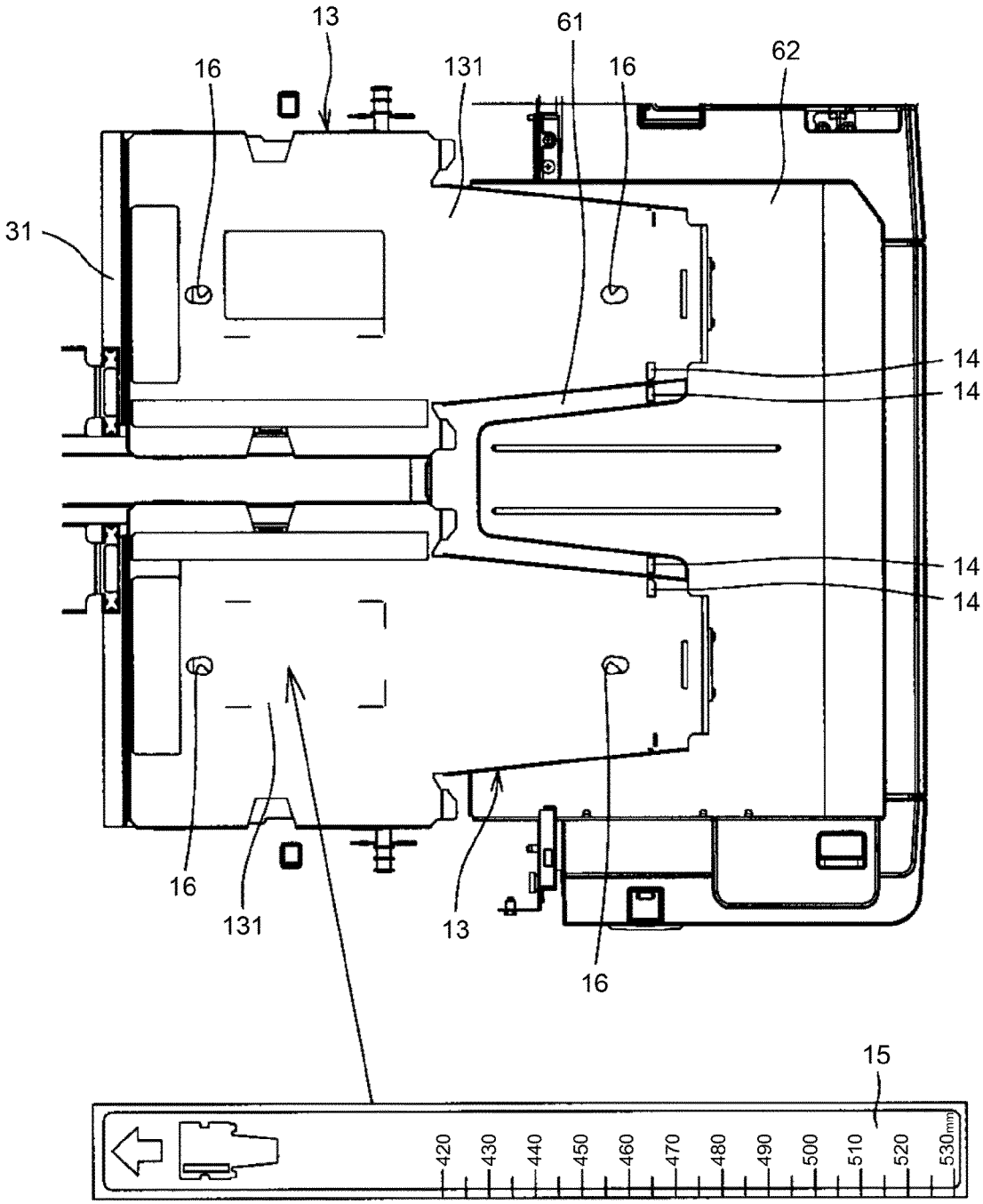
FIG. 21 is a top view of the tray bottom plate, the extension bottom plate, and the bases illustrated in FIG. 20.

As illustrated in FIG. 21, markings 14 for mutual positioning are provided on the table portions 131 of the bases 13 and the extension bottom plate 61. A magnet 133A or a hook 133B, which is a locking structure for removably attaching the vertical plate portion 132 to the extension bottom plate 61, is arranged on some of the vertical plate portions 132 of the bases 13. The magnet 133A is arranged on the vertical plate portion 132 at the upstream side in the conveying direction Y1 to be magnetically attached to the upstream end surface of the extension bottom plate 61 in the conveying direction Y1. The hooks 133B are provided on the vertical plate portions 132 at the both sides in the sliding direction Y2 and are hooked in hooking portions 31B (FIG. 20) provided in the tray bottom plate 31. The hooks 133B are formed such that distal ends of the hooks 133B project downstream in the conveying direction Y1.

According to the structure as described above, the bases 13 are placed on the tray bottom plate 31 and the extension bottom plate 61 and pushed downstream in the conveying direction Y1. When the bases 13 are pushed until the markings 14 on the bases 13 are aligned with the markings 14 on the extension bottom plate 61 as illustrated in FIG. 21, the hooks 133B are caught in the hooking portions 31B of the tray bottom plate 31. Furthermore, the magnets 133A are magnetically attached to the extension bottom plate 61, thereby fixing the bases 13 to the tray bottom plate 31 and the extension bottom plate 61. The bases 13 can be removed easily by pulling the bases 13 upstream in the conveying direction Y1.

Detachably arranging the bases 13 on the tray bottom plate 31 and the extension bottom plate 61 as described above allows standard-size sheets to be staked in a state where not only the optional extension unit 6 but also the bases 13 are removed from the tray bottom plate 31. Use of the locking structure such as the magnet 133A and the hook 133B makes it easy to attach and remove the bases 13. Arranging the bases 13 to be symmetric about the symmetry axis extending along the conveying direction Y1 leads to reduction in increase in manufacturing cost.

As illustrated in FIG. 21, a metering indicator 15 indicating the position where the long sheets 7 are placed is provided on the table portion 131 of the base 13. A scale indicating, for example, the length of the long sheets 7 may be provided on the metering indicator 15. When placing the long sheets 7, a user can align the upstream ends of the long sheets 7 in the conveying direction Y1 with a point of the scale indicating the length of the long sheets 7. The metering indicator 15 thus allows the long sheets 7 to be stacked such that the downstream ends of the long sheets 7 in the conveying direction Y1 abuts against the sheet feeding tray 3.

Figure 22A:
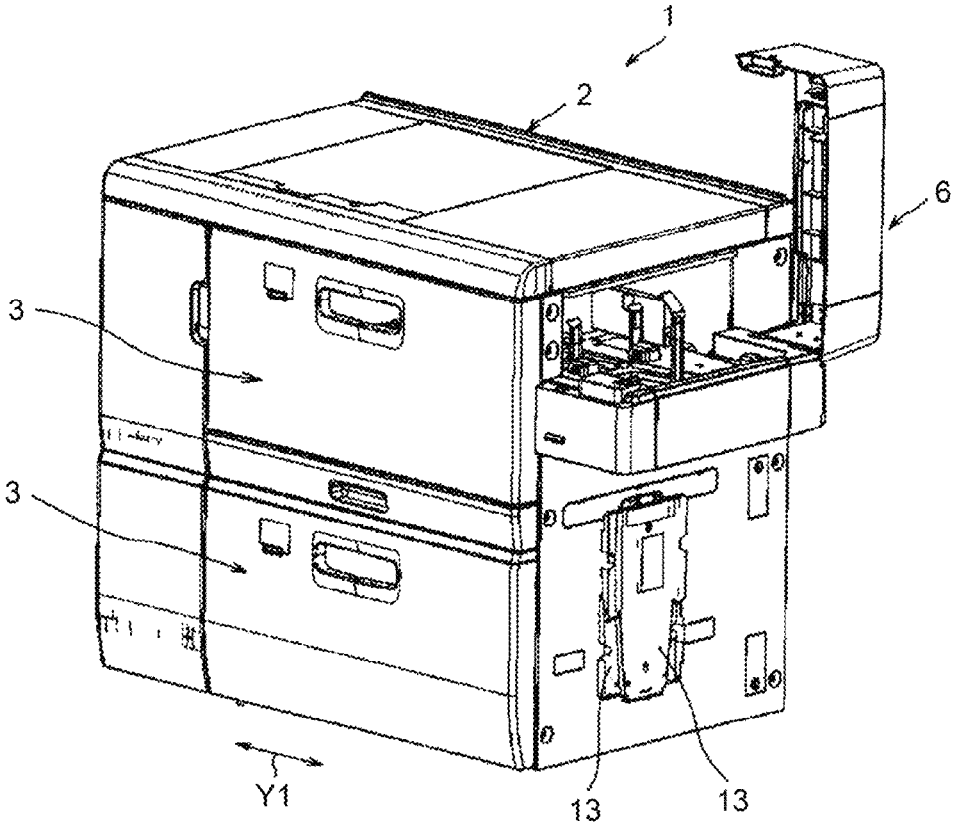
FIGS. 22A and 22B are perspective views of the LCT, with the bases illustrated in FIG. 21 removed therefrom, attached to the casing.
Figure 22B:
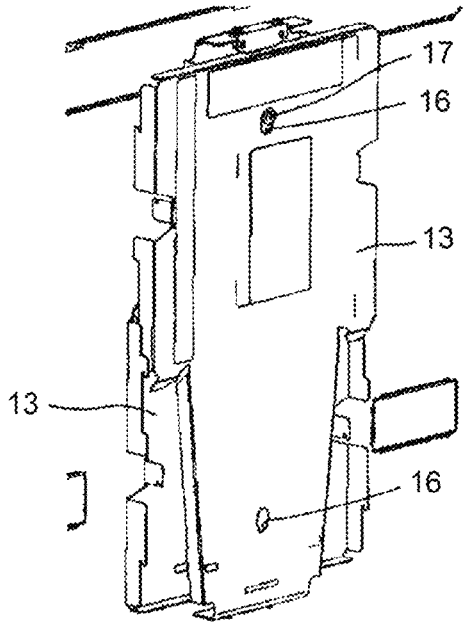

Hitch holes 16 are defined in each of the table portions 131 of the bases 13. More specifically, the table portion 131 has a pair of the hitch holes 16 arranged in the conveying direction Y1. This allows the two bases 13 to be overlapped as illustrated in FIGS. 22A and 22B when the bases 13 are out of use. At this time, the bases 13 are to be stacked such that the upstream hitch hole 16 of one of the pair of bases 13 in the conveying direction Y1 lies on the downstream hitch hole 16 of the other one of the bases 13 in the conveying direction Y1. The stacked pair of bases 13 can be stored in a state of being hung on a hook 17 provided on the casing 2 by inserting the hook 17 into the hitch holes 16.

According to the second embodiment described above, the bases 13 are removably mounted on the extension bottom plate 61; however, example embodiments are not limited thereto. For instance, a modification in which the bases 13 are formed in one piece with the extension bottom plate 61 may be employed.

Furthermore, shape and layout of the bases 13 are not limited to those illustrated in FIGS. 18A to 22B. The bases 13 may have any shape and layout so long as the bases 13 displace the center axis C of the long sheets 7 upward as illustrated in FIG. 17B with respect to the center axis C of the long sheets 7 placed on the tray bottom plate 31 and the extension bottom plate 61 which are flat as illustrated in FIG. 17A. For instance, the shape of the base 13 is not limited to that having a horizontal surface. The base 13 may be shaped to have a slope which extends from the downstream end of the tray bottom plate 31 in the conveying direction Y1 to the upstream end of the extension bottom plate 61 in the conveying direction Y1 and which gradually increases in height toward the upstream.

Third Embodiment

Figure 23A:
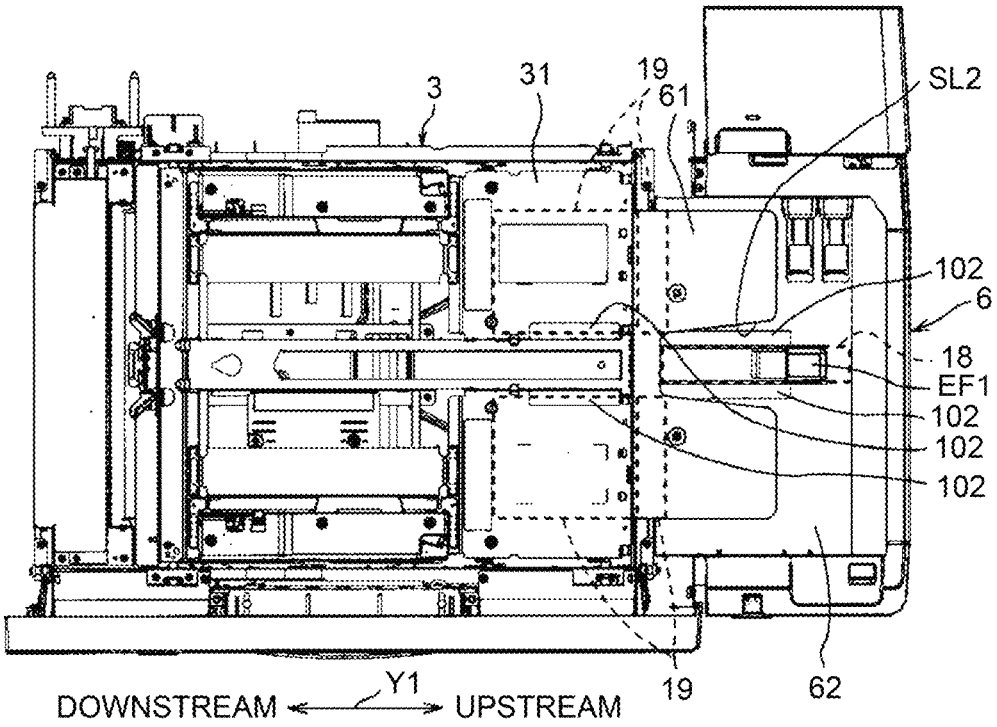
FIGS. 23A and 23B are top views of the sheet feeding tray and the optional extension unit of an LCT according to a third embodiment.
Figure 23B:
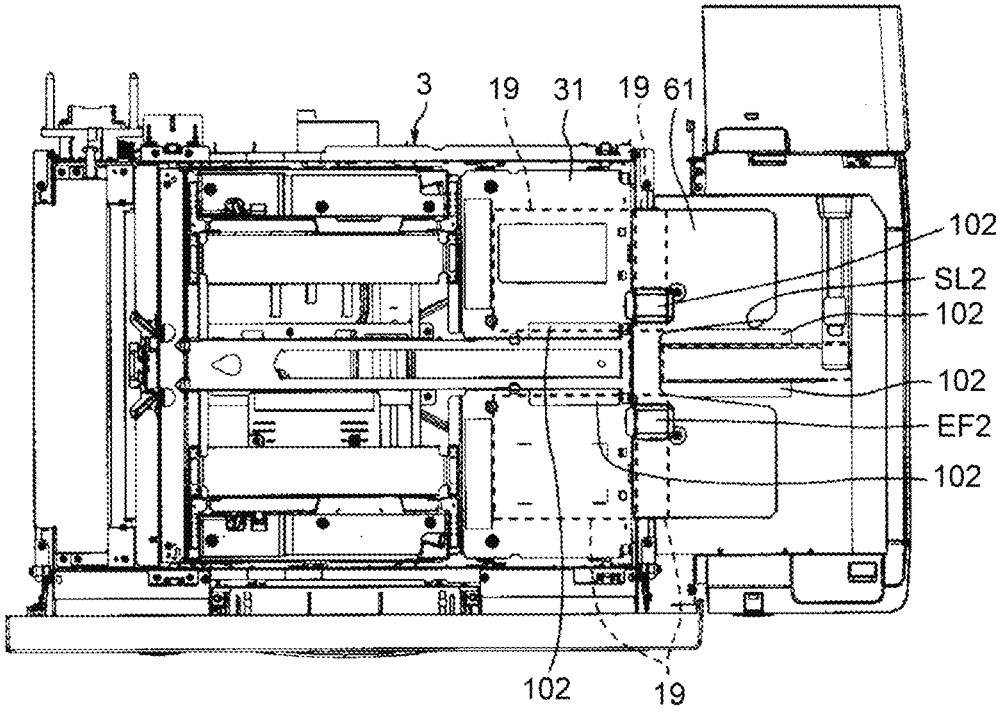

A third embodiment of the present invention is described below. Details of the end fence EF1, which is omitted in the first embodiment described above, are described below. As illustrated in FIGS. 23A and 23B, a slit SL2 for allowing the end fence EF1 to project is defined in the extension bottom plate 61. The slit SL2 extends in the conveying direction Y1 from the upstream end of the extension bottom plate 61 in the conveying direction Y1 to a position slightly upstream of the downstream end of the same.

A magnet attracting member 18 formed of a magnet, a metal plate, or the like to which the magnet on the end fence EF1 is magnetically attached so that the end fence EF1 can be selectably and removably fixed is arranged on the extension-unit base 62. The magnet attracting member 18 is arranged along the conveying direction Y1 at a position facing at least the slit SL2. The magnet attracting member 18 can provide its function so long as the magnet attracting member 18 extends to a position facing the slit SL2. However, in the third embodiment, the magnet attracting member 18 further extends upstream in the conveying direction Y1. The end fence EF1 can be removably arranged at any position on the magnet attracting member 18. However, if the end fence EF1 is mounted on the extension-unit base 62, the end fence EF1 fails to abut against the ends of the long sheets 7 in a case where the long sheets 7 are small in length and upstream ends of the long sheets 7 in the conveying direction Y1 are positioned downstream of the slit SL2.

To overcome this disadvantage, the LCT 1 according to the second embodiment includes, in addition to the end fence EF1 that is selectably and removably fixable to the extension-unit base 62, an end fence EF2 that is selectably and removably fixable to the extension bottom plate 61 as illustrated in FIG. 23B. The LCT 1 includes a pair of the end fences EF2. Each of the end fences EF2 includes a magnet at its basal portion at which the end fence EF2 is mounted on the extension bottom plate 61 as does the end fence EF1. Magnet attracting members 19, to which the magnets on the end fences EF2 are to attach, are arranged on the extension bottom plate 61. The magnet attracting members 19 are positioned downstream, with respect to the conveying direction Y1, of the slit SL2. This allows arranging the end fences EF2 not only upstream, with respect to the conveying direction Y1, of the slit SL2 but also downstream of the same. The magnet attracting members 19 are provided also on the tray bottom plate 31. This allows arranging the end fences EF2 also on the tray bottom plate 31.

Metering indicators 102 indicating the position where the long sheets 7 are placed are provided on the extension-unit base 62 and the tray bottom plate 31. As in the case of the metering indicator 15 illustrated in FIG. 21, a scale indicating the length of the long sheets 7 is provided on each of the metering indicators 102. A user can load and fix the end fences EF1 and EF2 at positions for the length of the long sheets 7.

Because the end fences EF2 are mounted on the extension bottom plate 61 or the tray bottom plate 31, the end fences EF2 are lifted up/down together with the tray bottom plate 31. For this reason, it is desirable that the end fence EF2 has such a height that will not cause contact between the end fence EF2 and a ceiling panel 24 even if the tray bottom plate 31 is lifted up. In contrast thereto, the end fence EF1 mounted on the extension-unit base 62 is not lifted up/down together with the tray bottom plate 31. Accordingly, the end fence EF1 can be of any height that will not cause contact with the openable cover 63. The end fence EF1 higher than the end fences EF2 may be used as required.

However, if the end fence EF1 is configured to be higher than the end fences EF2, it is possible that a user mounts the end fence EF1, which is higher than the end fences EF2, on the extension bottom plate 61 or the tray bottom plate 31 by mistake. In this case, the sheet feeding tray 3 or the like can be damaged as a result of contact between the end fence EF1 and the ceiling panel 24 of the casing 2.

Figure 24A:
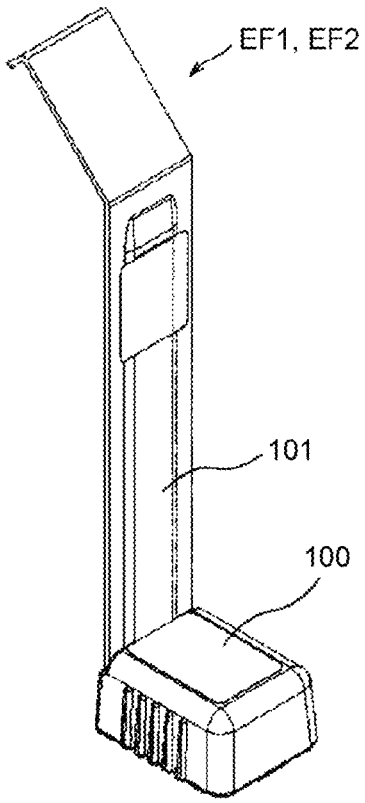
FIGS. 24A and 24B are perspective views of an end fence illustrated in FIGS. 23A and 23B.
Figure 24B:
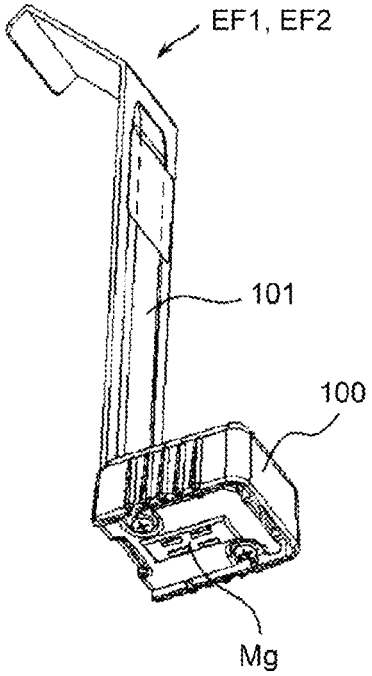
Figure 25:
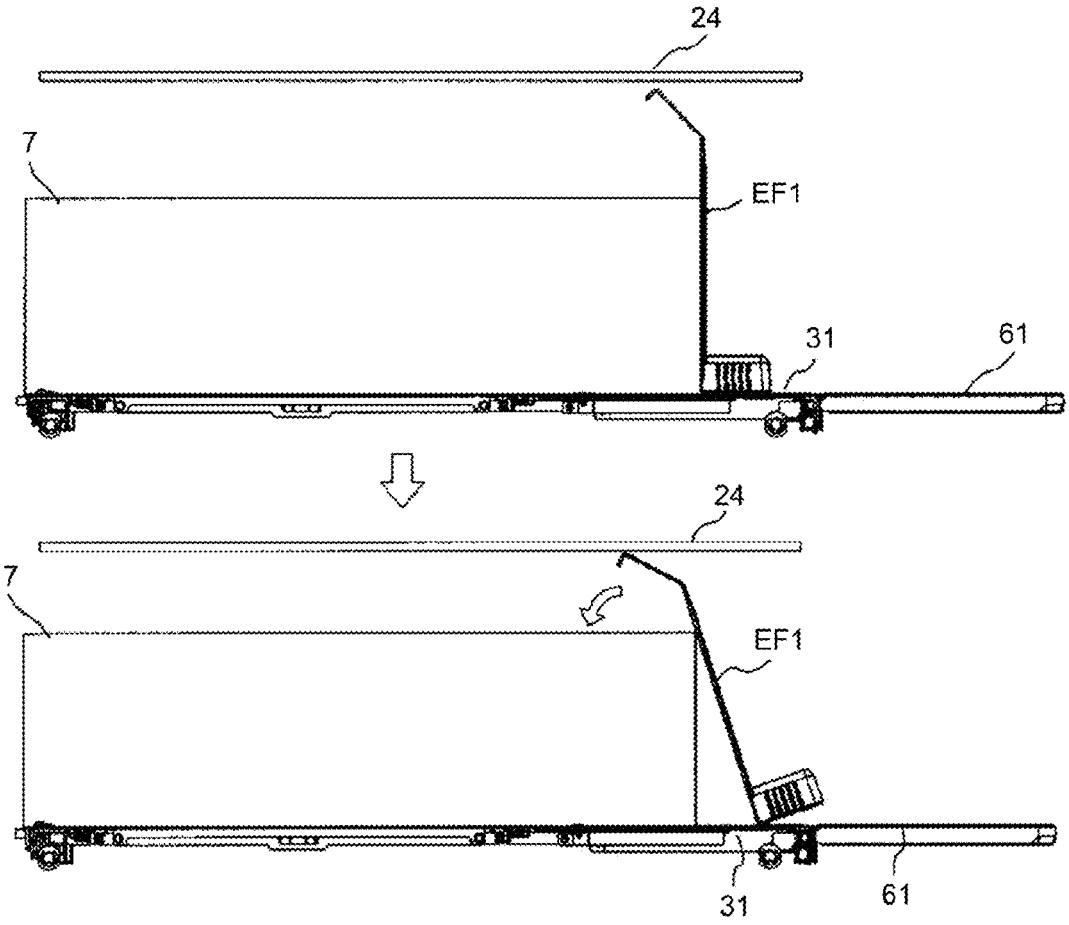
FIG. 25 is an explanatory diagram for describing how the end fence illustrated in FIGS. 24A and 24B moves when the end fence comes into contact with a ceiling panel of the casing.

To avoid such a problem, the end fences EF1 and EF2 configured as illustrated in FIGS. 24A and 24B may be employed. As illustrated in FIGS. 24A and 24B, each of the end fences EF1 and EF2 includes a base 100 and a plate-like fence body 101 projecting from the base 100 upward in the stacking direction Y3. A magnet Mg is arranged on bottom surface of the base 100. A color, marking, or the like for identifying which one of the end fences EF1 and EF2 the end fence is put on top portion of the base 100. The color, marking, or the like can prevents the user from mixing up between the end fences EF1 and EF2.

Distal end of the fence body 101 is obliquely bent. This shape allows, even if a user should mount the end fence EF1, which is longer than the end fences EF2, on the tray bottom plate 31 or the extension bottom plate 61 by mistake and the distal end of the end fence EF1 contacts the ceiling panel 24 of the casing 2, the end fence EF1 topples down. Thus, the sheet feeding tray 3 or the like is prevented from being damaged.

Figure 26:
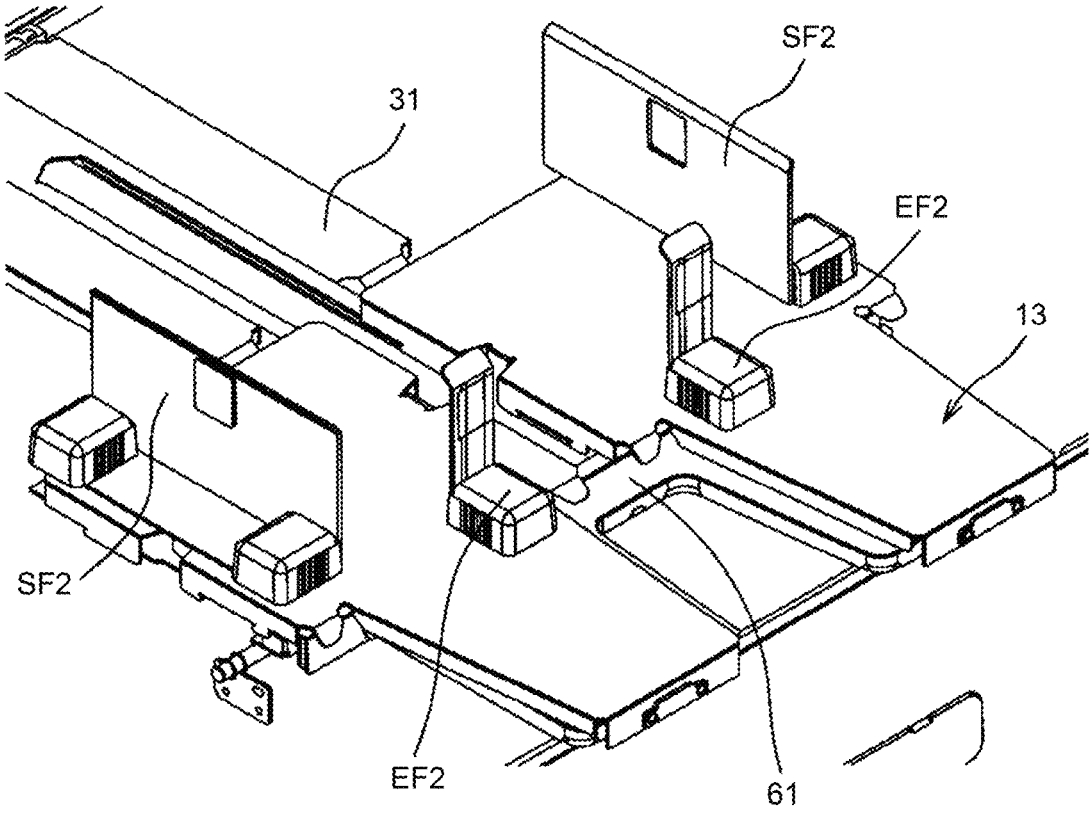
FIG. 26 is a top view of a modification of the sheet feeding tray, the extension bottom plate, and the bases of the LCT according to the third embodiment.

The end fences EF2 described above are also removably mountable on the bases 13 formed of a metal plate described above in the second embodiment, as illustrated in FIG. 26. A modification in which side fences SF2 are also removably fixable to the bases 13 as illustrated in FIG. 26 may be employed. Each of the side fences SF2 includes, as does the end fences EF1 and EF2, a magnet at its basal portion at which the side fence SF2 is mounted on the base 13.

The configuration in which the end fences EF1 and EF2 are removably fixable to the extension bottom plate 61, the tray bottom plate 31, and the extension-unit base 62 as in the third embodiment described above allows a user to mount the end fences EF1 and EF2 at positions appropriate for the length of the long sheets 7.

According to the third embodiment described above, the magnet attracting member 19 is arranged on each of the tray bottom plate 31 and the extension bottom plate 61; however, example embodiments are not limited thereto. The magnet attracting member 19 may alternatively be arranged on any one of the tray bottom plate 31 and the extension bottom plate 61. If each of the tray bottom plate 31 and the extension bottom plate 61 is formed of a metal plate, the need of additionally providing the magnet attracting member 19 is eliminated.

According to the third embodiment described above, the magnets Mg are arranged on the end fences EF1 and EF2; however, example embodiments are not limited thereto. A modification in which magnets are arranged on the extension-unit base 62, the extension bottom plate 61, and the tray bottom plate 31, while metal plates are arranged on the basal portions of the end fences EF1 and EF2 may be employed.

According to the third embodiment described above, the end fences EF1 and EF2 are configured to be removably attachable by utilizing the magnets; however, example embodiments are not limited thereto. Any known method that allows removably fixing the end fences EF1 and EF2 can be employed. For instance, a modification in which rails extending in the conveying direction Y1 are arranged on the extension-unit base 62, the extension bottom plate 61, and the tray bottom plate 31, and the end fences EF1 and EF2 are fixed by bringing the basal portions of the end fences EF1 and EF2 into slidable engagement with the rails may be employed.

According to the third embodiment described above, the end fences EF1 and EF2, which are of two types differing in height, are employed; however, example embodiments are not limited thereto. A modification including only one pair of end fences, which are identical in height, may be employed. With this modification, the pair of end fences is mounted when for use on the tray bottom plate 31 or the extension bottom plate 61, but only one of the pair of end fences is mounted when for use on the extension-unit base 62.

According to a sheet feeding device according to an aspect of the present invention, a first locking unit can be held in a first lock position where the sheet feeding tray cannot be slid when an optional extension unit is attached while, when the optional extension unit is removed, held in a first unlock position where the sheet feeding tray can be slid. Accordingly, if the first locking unit is held in the first lock position when the optional extension unit is attached, even if a user attempts to slide the sheet feeding tray by mistake, because the sheet feeding tray is locked by the first locking unit and prevented from sliding, an extension bottom plate is prevented from being damaged.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a casing;

a sheet feeding tray attached to the casing in a manner that the sheet feeding tray can be slid into and out from the casing and including a stacking plate on which sheets are to be stacked;

a conveying unit configured to convey the sheets stacked on the stacking plate in a direction orthogonal to both a sliding direction of the sheet feeding tray and a stacking direction of the sheets;

an optional extension unit configured to be removably attached to an upstream side of the stacking plate in a conveying direction, and including an extension plate configured to extend the stacking plate to allow a long sheet to be stacked; and a first locking unit configured to be capable of being held in a first lock position where the sheet feeding tray cannot be slid when the optional extension unit is attached while, when the optional extension unit is removed, held in a first unlock position where the sheet feeding tray can be slid.

2. The sheet feeding device according to claim 1, further comprising:

a slide operation unit with which a sliding operation of the sheet feeding tray is to be performed; and a second locking unit configured to move, in conjunction with the sliding operation performed using the slide operation unit, from a second lock position where the sheet feeding tray cannot be slid to a second unlock position where the sheet feeding tray can be slid, wherein the first locking unit is configured to lock the second locking unit to prevent the second locking unit from moving from the second lock position to the second unlock position when the first locking unit is in the first lock position.

3. The sheet feeding device according to claim 2, wherein the first locking unit is configured to be moved from the first unlock position to the first lock position by being pushed by the optional extension unit.

4. The sheet feeding device according to claim 2, wherein the first locking unit includes:

a lock piece configured to be movable between the first lock position where the sheet feeding tray cannot be slid and the first unlock position where the sheet feeding tray can be slid; and an urging unit configured to urge the lock piece to the first unlock position.

5. The sheet feeding device according to claim 2, further comprising a lower-to-limit operation unit with which an operation for lowering the stacking plate to a lower-limit position is to be performed.

6. The sheet feeding device according to claim 5, further comprising a control unit, wherein the optional extension unit includes an openable cover that can be opened and closed and configured to cover the extension plate from above, and the control unit is configured to lower the stacking plate to the lower-limit position when the lower-to-limit operation unit is operated, and lift the stacking plate to an upper-limit position when the openable cover is changed from an open state to a closed state.

7. The sheet feeding device according to claim 2, further comprising a control unit, wherein the optional extension unit includes an openable cover that can be opened and closed and configured to cover the extension plate from above, and the control unit is configured to lower the stacking plate to the lower-limit position when the openable cover is opened, and lift the stacking plate to an upper-limit position when the openable cover is closed.

8. The sheet feeding device according to claim 2, wherein the first locking unit is provided at both sides of the sheet feeding tray in the conveying direction.

9. The sheet feeding device according to claim 2, wherein a plurality of the sheet feeding trays is housed in the casing in a vertically-stacked arrangement, and the optional extension unit is removably attached to each of the sheet feeding trays.

10. The sheet feeding device according to claim 2, further comprising:

an air blowing unit configured to blow air to the sheets, thereby lifting up downstream ends of the sheets in the conveying direction toward the conveying unit; and a height increasing unit configured to cause the sheets to be stacked such that upstream portions of the sheets in the conveying direction are positioned at a higher level in the stacking direction than downstream portions of the sheets in the conveying direction.

11. The sheet feeding device according to claim 1, wherein the first locking unit is configured to be moved from the first unlock position to the first lock position by being pushed by the optional extension unit.

12. The sheet feeding device according to claim 1, wherein the first locking unit includes:

a lock piece configured to be movable between the first lock position where the sheet feeding tray cannot be slid and the first unlock position where the sheet feeding tray can be slid; and an urging unit configured to urge the lock piece to the first unlock position.

13. The sheet feeding device according to claim 1, further comprising a lower-to-limit operation unit with which an operation for lowering the stacking plate to a lower-limit position is to be performed.

14. The sheet feeding device according to claim 13, further comprising a control unit, wherein the optional extension unit includes an openable cover that can be opened and closed and configured to cover the extension plate from above, and the control unit is configured to lower the stacking plate to the lower-limit position when the lower-to-limit operation unit is operated, and lift the stacking plate to an upper-limit position when the openable cover is changed from an open state to a closed state.

15. The sheet feeding device according to claim 1, further comprising a control unit, wherein the optional extension unit includes an openable cover that can be opened and closed and configured to cover the extension plate from above, and the control unit is configured to lower the stacking plate to the lower-limit position when the openable cover is opened, and lift the stacking plate to an upper-limit position when the openable cover is closed.

16. The sheet feeding device according to claim 1, wherein the first locking unit is provided at both sides of the sheet feeding tray in the conveying direction.

17. The sheet feeding device according to claim 1, wherein a plurality of the sheet feeding trays is housed in the casing in a vertically-stacked arrangement, and the optional extension unit is removably attached to each of the sheet feeding trays.

18. The sheet feeding device according to claim 1, further comprising:

an air blowing unit configured to blow air to the sheets, thereby lifting up downstream ends of the sheets in the conveying direction toward the conveying unit; and a height increasing unit configured to cause the sheets to be stacked such that upstream portions of the sheets in the conveying direction are positioned at a higher level in the stacking direction than downstream portions of the sheets in the conveying direction.

19. The sheet feeding device according to claim 1, wherein the optional extension unit includes an extension-unit base fixed to the casing, and an end fence is selectably and removably fixable to the extension-unit base and at least one of the extension plate and the stacking plate.

20. An image forming apparatus comprising the sheet feeding device according to claim 1.

* * * * *